US012480320B1

(12) United States Patent
Staerk et al.

(10) Patent No.: US 12,480,320 B1
(45) Date of Patent: Nov. 25, 2025

(54) MODULAR TREATMENT, EXAMINATION, AND WAITING STATION

(71) Applicants: DIRTT ENVIRONMENTAL SOLUTIONS, INC., Chicago, IL (US); HKS, Inc., Dallas, TX (US)

(72) Inventors: Sandra D. Staerk, Red Deer (CA); Benjamin Richard Pankhurst, Calgary (CA); Deborah M. Wingler, Dallas, TX (US); Colby Brian Dearman, Atlanta, GA (US)

(73) Assignee: DIRTT ENVIRONMENTAL SOULTIONS LTD. (CA)

( * ) Notice: Subject to any disclaimer, the term of this patent is extended or adjusted under 35 U.S.C. 154(b) by 0 days.

(21) Appl. No.: 19/224,164

(22) Filed: May 30, 2025

Related U.S. Application Data

(60) Provisional application No. 63/773,220, filed on Mar. 17, 2025.

(51) Int. Cl.
*E04H 1/12* (2006.01)
*A47C 11/00* (2006.01)

(52) U.S. Cl.
CPC ..... *E04H 1/1205* (2013.01); *A47C 11/00* (2013.01)

(58) Field of Classification Search
CPC ..... A47C 11/00; E04H 1/1205; E04H 1/125; A47B 2200/0071
See application file for complete search history.

(56) References Cited

U.S. PATENT DOCUMENTS

| | | | | |
|---|---|---|---|---|
| 10,907,370 | B1 * | 2/2021 | Waskey | E04B 1/82 |
| 2020/0163480 | A1 * | 5/2020 | Waisanen | E05B 65/06 |
| 2022/0081894 | A1 * | 3/2022 | Schmid | E04H 1/125 |
| 2022/0136231 | A1 * | 5/2022 | Zail | E04B 2/827 52/65 |
| 2023/0151626 | A1 * | 5/2023 | Wall | E06B 3/7007 52/64 |
| 2023/0160225 | A1 * | 5/2023 | Yamanashi | E04H 1/125 52/79.1 |

* cited by examiner

*Primary Examiner* — Gisele D Ford
(74) *Attorney, Agent, or Firm* — Workman Nydegger

(57) ABSTRACT

A modular treatment, examination, and waiting station can include a back module with a bench and opposing towers, and first and second side modules extending in the same direction from the back module. Each side module may include a recessed storage space. Modular treatment, examination, and waiting station modules may define a floor space of less than 50 square feet. The modular treatment, examination, and waiting station may also include a ceiling module supported by the towers of a back module. One or more modular treatment, examination, and waiting stations may act as a system and may be configured in multi-station arrangements, with shared side modules providing access to equipment from adjacent stations.

20 Claims, 22 Drawing Sheets

MODULAR TREATMENT, EXAMINATION, AND WAITING STATION

CROSS-REFERENCE TO RELATED APPLICATIONS

The present application incorporates by reference in its entirety and claims the priority benefit of U.S. Provisional Patent Application Ser. No. 63/773,220, entitled "MODULAR TREATMENT, EXAMINATION, AND WAITING STATION," filed on Mar. 17, 2025.

BACKGROUND

Emergency room (ER) triaging often suffers from inefficiencies and low throughput due to the design and size of treatment rooms. Many emergency rooms were originally built with large, multipurpose spaces intended to accommodate a wide range of patient needs. While these expansive rooms may have been practical at the time of construction, they are frequently underutilized for triaging purposes, where smaller, more flexible spaces would suffice. The result is an inefficient use of space, as a single patient requiring minimal intervention might occupy a large room for an extended period, preventing other patients from being seen in a timely manner. This bottleneck significantly reduces the overall throughput of the emergency department, contributing to long wait times and delays in care. In some instances, these inefficiencies are compounded by increasing populations serviced by emergency room centers.

Efforts to address these inefficiencies by remodeling emergency rooms face significant obstacles. Renovations typically require substantial downtime, with parts of the ER being taken out of service for weeks or even months at a time. This reduction in capacity creates additional strain on the remaining facilities, leading to even greater inefficiencies and potentially jeopardizing patient care. Furthermore, ERs are often designed with rigid layouts that make adapting to new care needs or updated regulations a challenging and resource-intensive process. Implementing even minor changes, such as updating equipment, modifying room configurations, or installing new technology, often requires the involvement of specialized labor, including electricians, plumbers, and contractors. These professionals must work around sensitive medical infrastructure, further complicating and prolonging the remodeling process. The inability to make quick, cost-effective changes to emergency room layouts undermines the adaptability of these spaces, leaving them ill-suited to meet the evolving demands of modern healthcare.

The subject matter claimed herein is not limited to embodiments that operate only in environments such as those described above. Rather, this background is only provided to illustrate one exemplary technology area where some embodiments described herein may be practiced.

SUMMARY

A modular treatment, examination, and waiting station may include a back module. The back module can include a bench that has a first end and a second end, and the bench can be positioned along a lower portion of the back module. The bench may also include a first tower positioned at the first end of the bench and a second tower positioned at the second end of the bench. The modular treatment, examination, and waiting station may also include a first side module connected to the back module. The first side module can have a first storage space recessed into the first side module. The modular treatment, examination, and waiting station can also have a second side module connected to the back module. The second side module may also have a second storage space recessed into the second side module wherein the first side module and the second side module extend from the back module in a same direction. A floor space can be defined by the back module, the first side module, the second side module, and front ends of the first side module and the second side module and may take up less than about 50 square feet. Additionally, the bench, the first tower, and the second tower each can have one or more recesses or cabinets that allow users to access a respective internal space. The first recess or cabinet of the one or more recesses or cabinets of the first tower can provide a first opening that faces the second tower.

In another embodiment, a modular treatment, examination, and waiting station, may have a back module, the back module having a first end and a second end. The back module can include a first tower positioned at the first end of the back module, and a second tower positioned at the second end of the back module. The modular treatment, examination, and waiting station may also have a first side module connected to the back module. The first side module can include a first storage space recessed into the first side module. The modular treatment, examination, and waiting station can also have a second side module connected to the back module. The second side module can also have a second storage space recessed into the second side module. The first side module and the second side module can extend from the back module in a same direction and a floor space defined by the back module, the first side module, the second side module, and front ends of the first side module. The second side module can comprise less than about 50 square feet, and the first storage space can be positioned on the first side module within 3 feet of the front end of the first side module. Further, the second storage space can be positioned on the second side module within 3 feet of the front end of the second side module. The first tower or the second tower defines a recess can have a display where the display is mounted on a rotatable arm such that the display can be deployed outside of the recess for use by a user and stored completely within the recess when not in use by the user.

The present disclosure may also include a modular station system. The modular station system may include a first back module and a second back module arranged or secured adjacent to the first back module. A first side module can be secured to both the first back module and the second back module. The first side module can also include a first storage space recessed into the first side module. The system may also have a second side module secured to the first back module, where the first side module, the second side module, and the first back module define a first modular treatment, examination, and waiting station. Similarly, the system may include a third side module secured to the second back module, where the first side module, the third side module, and the second back module define a second modular treatment, examination, and waiting station. The first storage space can be accessed by way of the first modular treatment, examination, and waiting station, and a second storage space defined by the first side module can be accessed by way of the second modular treatment, examination, and waiting station. Additionally, the first storage space and the second storage space are positioned on the first side module within 3 feet of a front end of the first side module.

BRIEF DESCRIPTION OF THE DRAWINGS

References will be made to embodiments of the disclosure, examples of which may be illustrated in the accompanying figures. These figures are intended to be illustrative, not limiting. Although the disclosure is generally described in the context of these embodiments, it should be understood that it is not intended to limit the scope of the disclosure to these particular embodiments. Items in the figures are not necessarily drawn to scale.

DETAILED DESCRIPTION

Disclosed embodiments are directed to modular treatment, examination, and waiting stations, components thereof, and methods of manufacturing the same.

As noted above, emergency room triaging is often inefficient and has low throughput due to oversized treatment rooms that are poorly suited for quick, flexible patient care. Conventional ER stations occupy about 100 or more square feet of floor space. Efforts to remodel and improve these spaces are hindered by the significant downtime required, often taking parts of the ER out of service for weeks. Additionally, ERs are not easily adaptable to updated care needs or regulations, as even minor changes frequently require specialized labor and complex modifications, further delaying progress and straining resources.

At least some disclosed embodiments are directed to modular treatment, examination, and waiting stations ("modular stations") that have reduced size compared to traditional ER stations. For instance, a modular station as disclosed herein can occupy less than about 50 square feet of floor space. Modular stations, as disclosed herein, can significantly improve efficiency and throughput by better aligning with the specific needs of triage-level care. Such modular stations can allow for a greater number of patients to be evaluated simultaneously, maximizing the use of available square footage while minimizing the time spent waiting for treatment. By reducing the size of each triage area, emergency departments could allocate resources more effectively and create a more streamlined workflow, enabling staff to focus on immediate care needs rather than managing underutilized large rooms.

Modular stations can be constructed using modular components, such as wall panels/tiles and ceiling panels/tiles, with connection components for interfacing with horizontal and/or vertical stringers (or frame members). The adoption of modular wall and ceiling components to construct the modular stations, as disclosed herein, could further address inefficiencies of traditional ER designs. Modular components are inherently flexible, allowing spaces to be quickly reconfigured or expanded to meet changing care requirements or updated regulations. Unlike conventional remodeling, which often involves extended downtimes and requires specialized labor such as electricians and plumbers, modular construction minimizes disruption. Components can be pre-fabricated, installed with minimal on-site labor, and reconfigured with ease, ensuring that the ER remains operational during updates. This adaptability can also allow for cost-effective and timely integration of new technologies or compliance with evolving healthcare standards.

Having just described some of the high-level features and/or advantages associated with the disclosed embodiments, attention will now be directed to the Figures, which provide supporting illustrations for describing the disclosed embodiments.

Figure 1A:
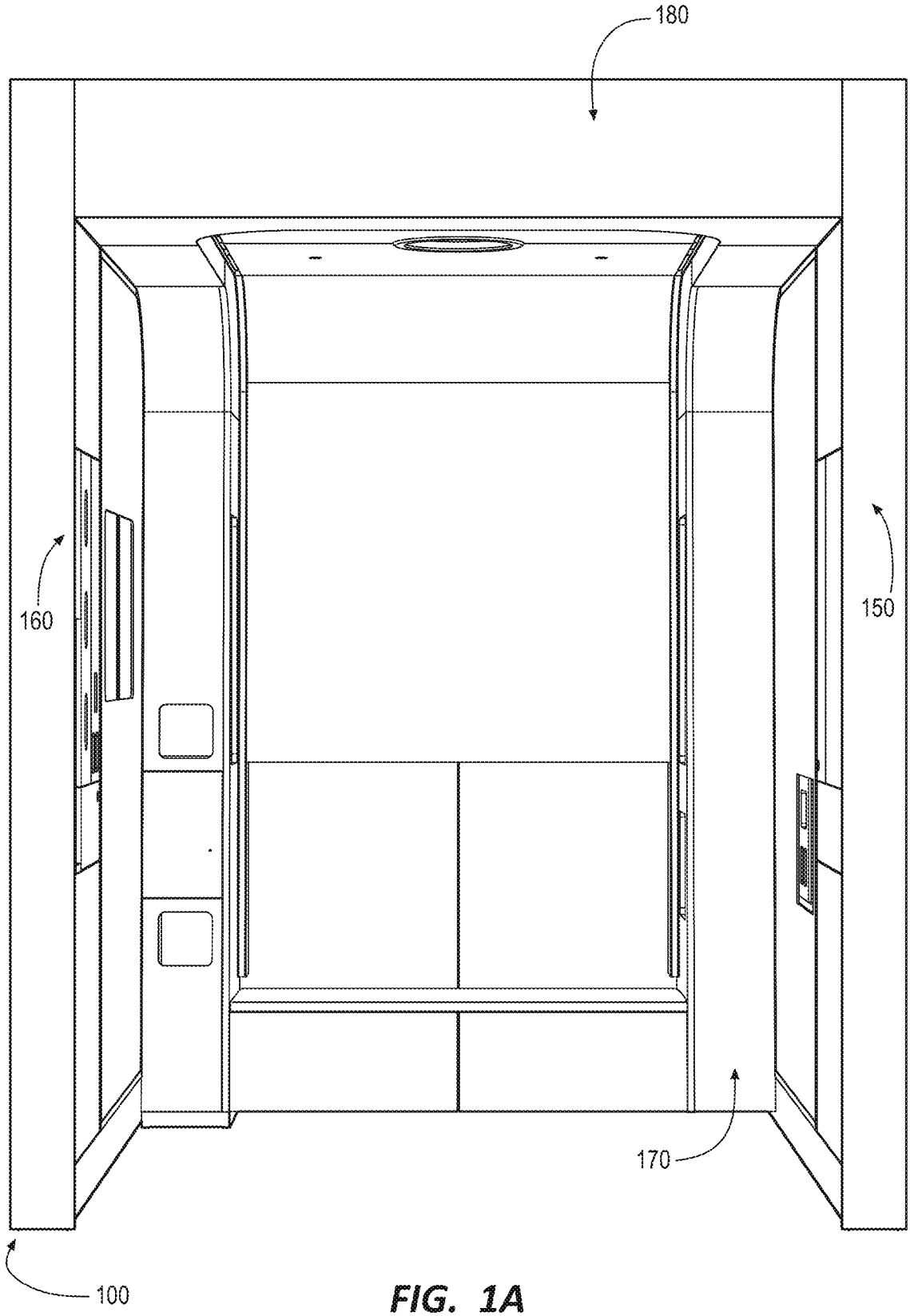
FIGS. 1A and 1B illustrate an example modular treatment, examination, and waiting stating ("modular station"), according to implementations of the disclosed subject matter.

FIG. 1A illustrates an example modular treatment, examination, and waiting station, referred to as modular station 100. The modular station 100 shown in FIG. 1A includes side modules 150 and 160, a back module 170, and a ceiling module 180. The side modules 150 and 160, the back module 170, and the ceiling module 180 can comprise one or more modular components (e.g., planar or curved tiles/modules, connection components, frame or stringer components), which may be pre-fabricated and assembled on-site. For example, a modular treatment, examination, and waiting station can include one or more internal horizontal frames, one or more internal vertical frames, and one or more panels or tiles. The horizontal frame, vertical frames, and panels or tiles can define a module's internal space or storage spaces. The horizontal and vertical frames can have attachment features such as grooves, channels, apertures, brackets, or any similar attachment feature or mechanism to allow a user or assembler to secure the horizontal frames to both vertical and horizontal frames, as well as vertical frames to both vertical and horizontal frames. A user or assembler may also use bolts, screws, or similar fasteners to secure horizontal and/or vertical frames to one another. The one or more panels or tiles may be modular panels or tiles, allowing for customization for each modular station. For example, the panels may be glass, plastic, metal, wood, composite, or other materials. The panels may secure the horizontal and vertical frames directly through clips, fasteners, hangers, or any suitable fastening system. A user may additionally, or alternatively, secure the panels to slides, pistons, rollers, hinges, or any similar mechanism that allows the panel to act as a door, cover, or front to a drawer that provides access to a storage space within one of the modules.

The tiles or panels that define a door or cover (e.g., cabinet door or drawer) may be substantially planar to the remaining panels or tiles that define an outer surface (e.g., ornamental surface) of a given module when the door, cover, drawer, etc., is in a closed position. For example, adjacent panels (e.g., even where at least one of the adjacent panels acts as a door or cover for an internal space defined by the side module) may be flush or co-planar to one another so that the outer surface of a module has a substantially flat elevation. This configuration can prevent the storage spaces defined by the side modules from undermining the working or standing space defined by the modular station. In some implementations, outer surfaces of adjacent panels/tiles of a side module (e.g., where one panel is a fixed wall panel, and where one panel encloses a storage space such as a drawer or a cabinet defined by the side module), may be planarly offset from one another by a distance less than about 6 inches (or less than about 5 inches, about 4 inches, about 3 inches, about 2 inches, or about 1 inch). In some implementations, the planar offset between the outer surfaces (e.g., surfaces oriented away from the horizontal and/or vertical frames of the side module) of adjacent panels, where one of the panels encloses a storage space) is less than the depth of the storage space defined by one of the panels. Such configurations may be present on opposing faces/sides of a side module. For instance, where a single side module serves to define/divide two adjacent treatment, examination, and waiting stations, the single side module may comprise (i) adjacent tiles/panels on one face/side thereof (with at least one of the tiles/panels serving to selectively enclose a storage space) with outer faces that are planarly offset by less than about 6 inches (or another distance) and (ii) adjacent tiles/panels on another, opposing face/side thereof (with at least one of the tiles/panels serving to selective enclose another storage space) with outer faces that are planarly offset by less than about 6 inches. Accordingly, a single side module may define recessed storage spaces that are accessible on opposing sides thereof (e.g., to service different adjacently arranged modular treatment, examination, and waiting stations).

The side modules may comprise internal shelving, walls, panels, etc., that can be used to define storage spaces therein. For example, a storage space can comprise shelving, walls, or panels at the top, sides, and/or bottom to define a cabinet (see walls 131 in FIG. 4). Modular station modules may additionally, or alternatively, comprise dividing walls 133 (see FIG. 4) that can act as a back wall for a cabinet or storage space and prevent access from one modular station to an adjacent one through a side module (e.g., a singe tile/panel of a side module can serve as a decorative/ornamental wall element for one modular station on one side while another, opposite side serves as a back wall of a storage space that is accessible from an adjacent modular station). A user may also utilize dividing walls 133 to mount or secure equipment.

As indicated above, the modular station 100 can comprise a reduced floor square footage relative to conventional ER triage rooms. In the example shown in FIG. 1A, the modular station 100 has a floor square footage of about 30 square feet (e.g., 5 ft×6 ft). Although not illustrated in FIG. 1A, the modular station 100 can include a cubicle curtain track for supporting a cubicle curtain to at least partially enclose the modular station 100. In other instances, the modular station 100 can support a front module that includes a door for selectively enclosing the modular station 100. The modular station 100 can comprise a floor-to-ceiling configuration (e.g., a full height configuration) or a partial height configuration (e.g., where one or more of the side modules 150, 160, or the back module 170 are freestanding and support the ceiling module 180).

Figure 1B:
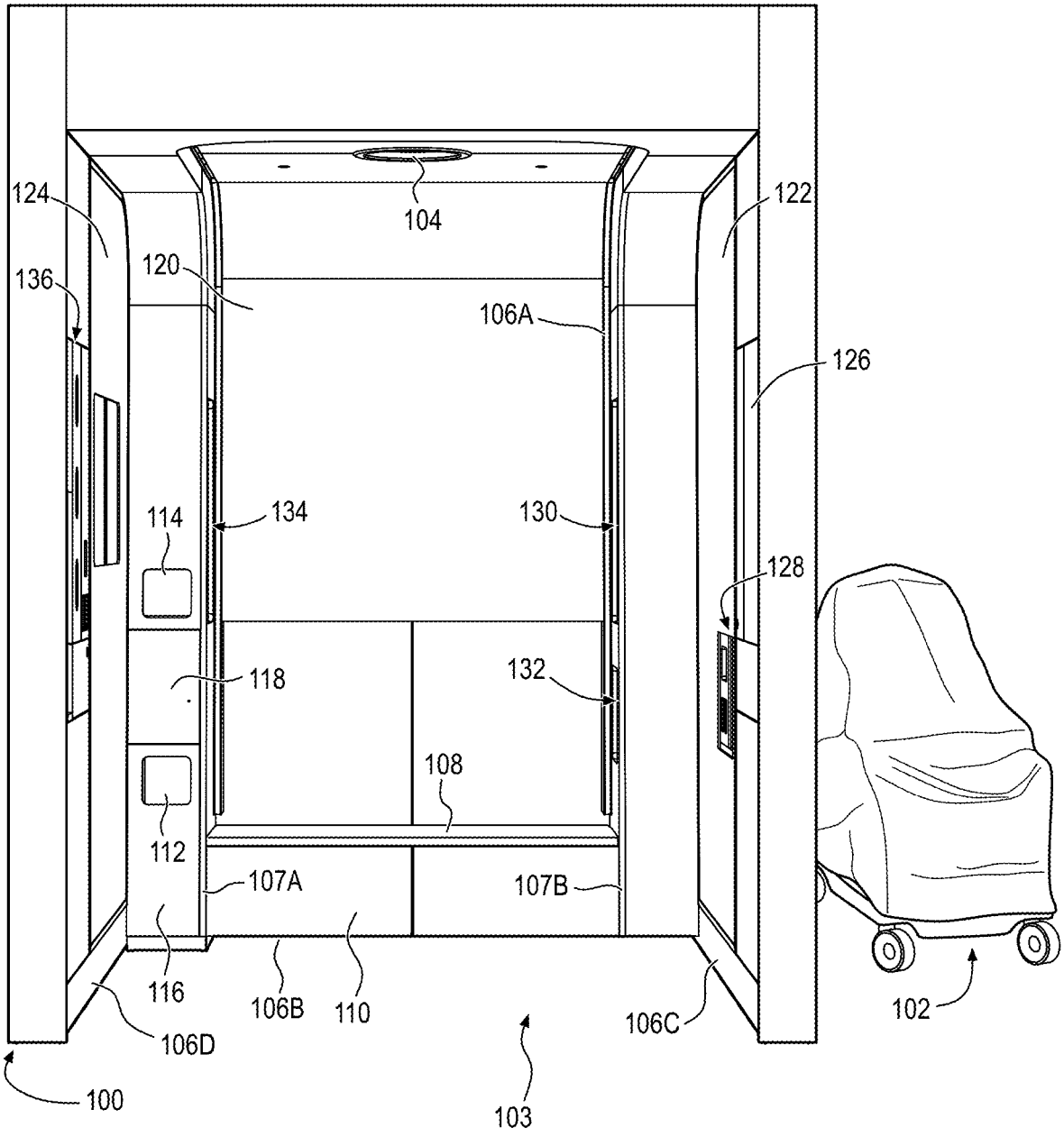

FIG. 1B illustrates the same example modular station 100 shown in FIG. 1A and includes reference labels associated with various components. FIG. 1B illustrates an example exam recliner 102, which may support patients at a vertical orientation for vertical exams, or may be configured to recline if needed to facilitate patient care. During use, the exam recliner 102 may be positioned within the modular station 100 proximate to side module 150 (e.g., within about 1 ft. or within about 2 ft. thereof), such as over position 103 shown in FIG. 1B.

FIG. 1B illustrates that the modular station 100 can include an exam light 104, such as an LED exam light, which may be motorized in some implementations. The exam light 104 can assist medical practitioners in making detailed visual assessments of patients, which can improve diagnosis. The exam light 104 can be controlled via one or more controls provided at a practitioner panel 136, described hereinafter. FIG. 1B further illustrates the modular station 100 as including continuous recessed lighting 106A (e.g., extending over at least part of the back module 170 and the ceiling module 180), 106B (e.g., proximate to the floor below the bench 108 of the back module 170), and 106C and 106D (e.g., extending over respective side modules 150 and 160). The recessed lighting 106A, 106B, 106C, and 106D can illuminate the modular station 100 without occupying significant free space within the modular station 100, which can maintain maneuverability within the modular station 100 and can provide a desirable aesthetic. In some implementations, the recessed lighting 106A, 106B, 106C, and/or 106D can be configurable to emit light with different brightness and/or color settings, which can be controlled via controls provided at the practitioner panel 136 and/or a patient panel 128 (described in more detail hereinafter). Controlling the brightness and/or color settings of the recessed lighting 106A, 106B, 106C, and/or 106D can facilitate user-driven or practitioner-driven lighting configurations that can affect patient stress levels and/or can promote positive patient outcomes.

In the example shown in FIG. 1B, the modular station 100 includes a bench 108 along a lower portion of the back module 170, which may provide seating for patient guests, caregivers, family members, and/or other individuals associated with the patient. The bench 108 can be positioned over one or more supply drawers 110, which can be used to store medical or other supplies for the modular station 100 and/or can receive patient and/or guest belongings. In some implementations, when the exam recliner 102 is in a reclined position, the head and/or back of the exam recliner 102 can become positioned over at least part of the seat of the bench 108.

As shown in FIG. 1B, the modular station 100 can include a waste container opening 112 positioned on at least part of the back module 170, which can provide access to a waste receptacle for receiving waste generated by the patient, guests, and/or medical practitioners. The modular station 100 can additionally or alternatively include a sharps disposal opening 114, which can provide access to a sharps receptacle for receiving hazardous waste generated pursuant to providing care for the patient.

Figure 2:
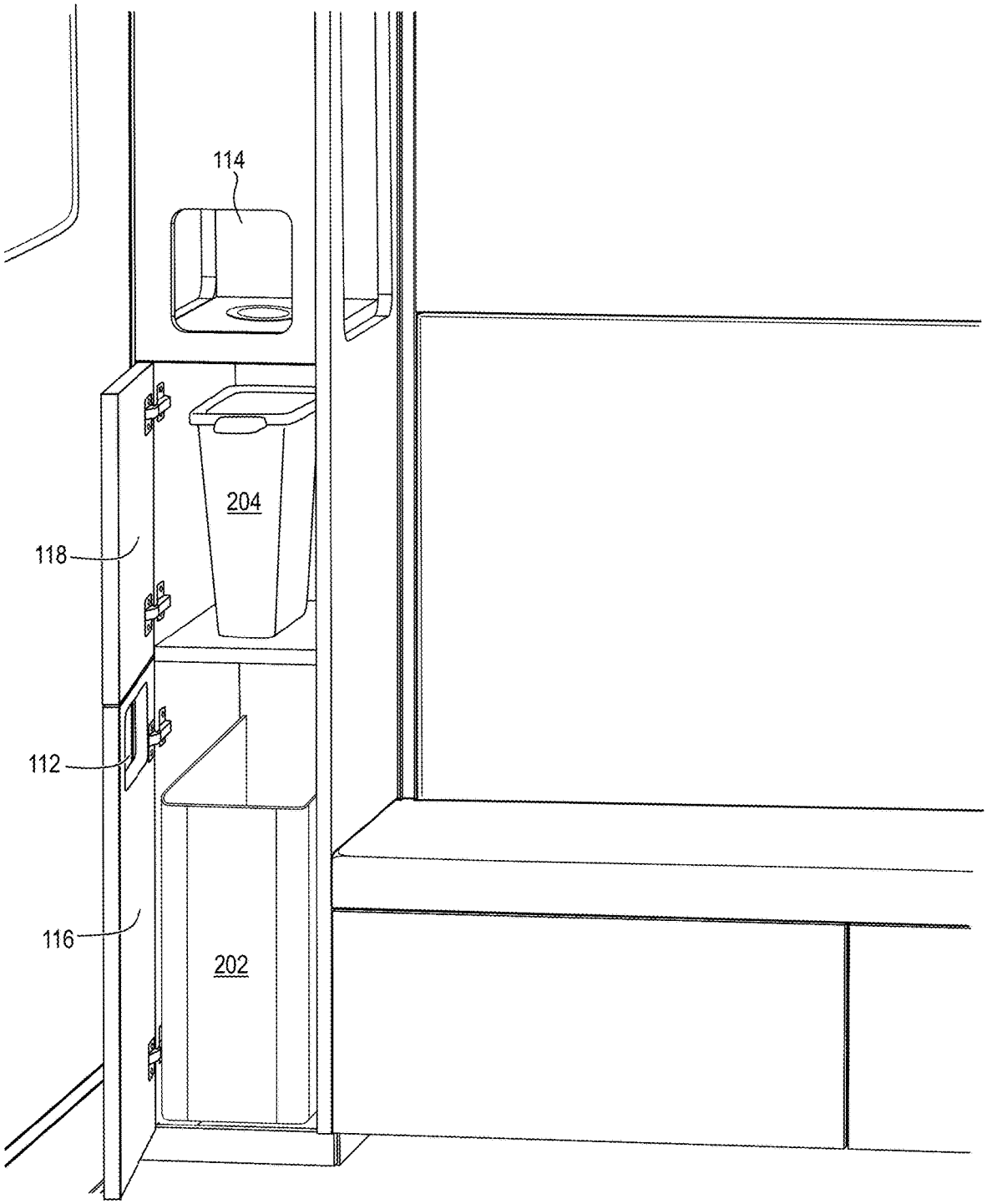
FIG. 2 illustrates a close-up view of a waste container opening and a sharps disposal opening of a modular station, according to implementations of the disclosed subject matter.

In the example shown in FIG. 1B, the waste container opening 112 is positioned on a cabinet door 116, which can provide access to the waste receptacle. FIG. 1B furthermore illustrates an additional cabinet door 118 for enclosing the sharps receptacle. FIG. 2 illustrates a close-up view of the waste container opening 112 and the sharps disposal opening 114, showing the cabinet doors 116 and 118 in an open configuration, exposing the waste receptacle 202 and the sharps receptacle 204. Although the cabinet door 116 and the additional cabinet door 118 are distinct cabinet doors in the example shown in FIGS. 1B and 2, other configurations are possible (e.g., where the waste container opening 112 is positioned on a single cabinet door that encloses both the waste receptacle 202 and the sharps receptacle 204).

The example modular station 100 shown in FIG. 1B includes an accent material 120 extending over at least part of the back module 170 and the ceiling module 180. The modular station 100 furthermore includes glass panels 122 and 124 (part of the side modules 150 and 160, respectively), which can be back painted to facilitate visual isolation between adjacent modular stations. The accent material 120 can comprise any suitable aesthetic layer, such as thermofoil, laminate, veneer, melamine, paint, glass, metal finish material, fabric or upholstered finish material, polymer-based finishes, and/or others. Although glass panels 122 and 124 are shown in the example of FIG. 1B, other types of finish materials may be used over the sidewalls defined by the side modules 150 and 160.

Figure 3:
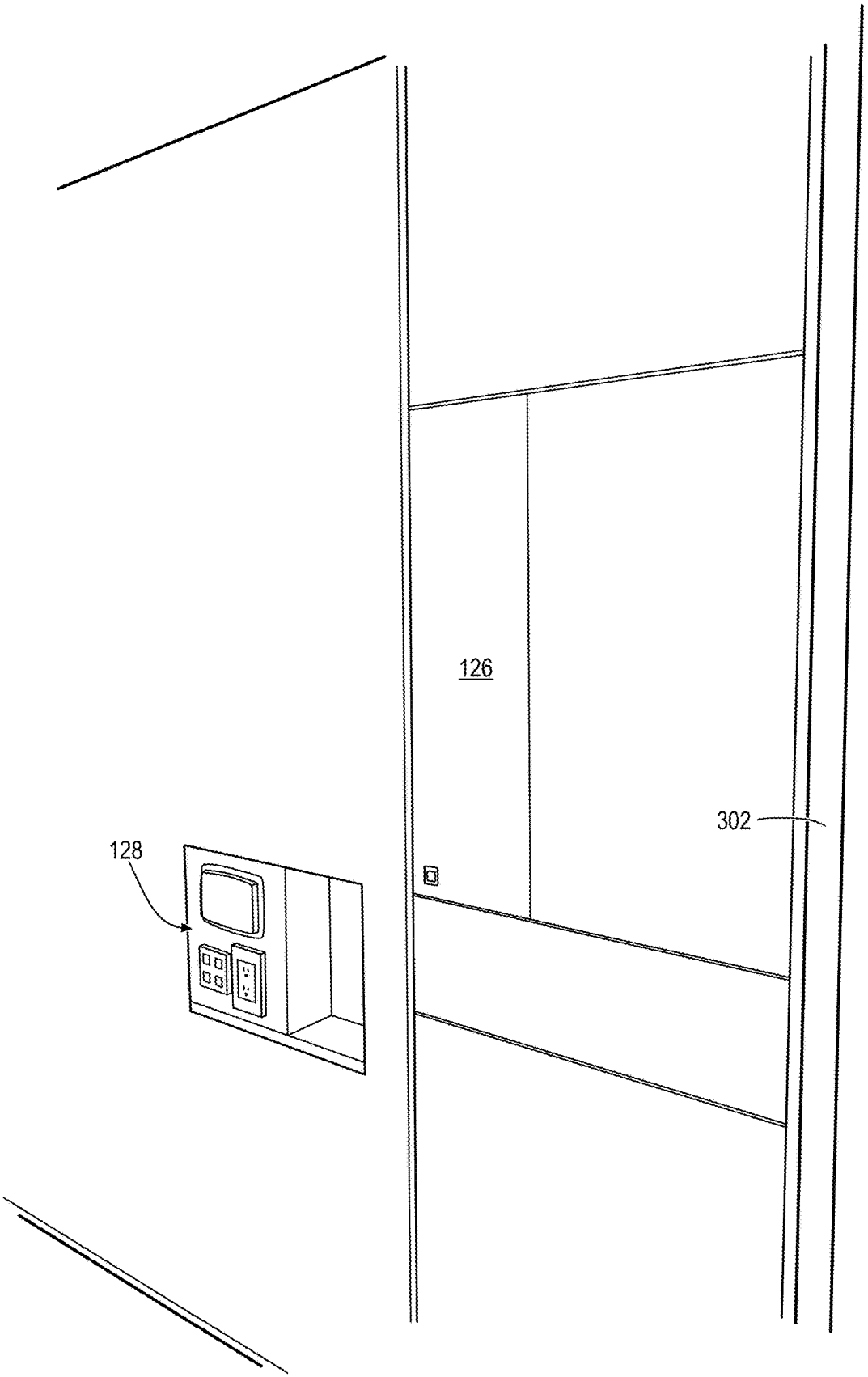
FIG. 3 illustrates a close-up view of a storage space of a modular station in a closed configuration, according to implementations of the disclosed subject matter.
Figure 4:
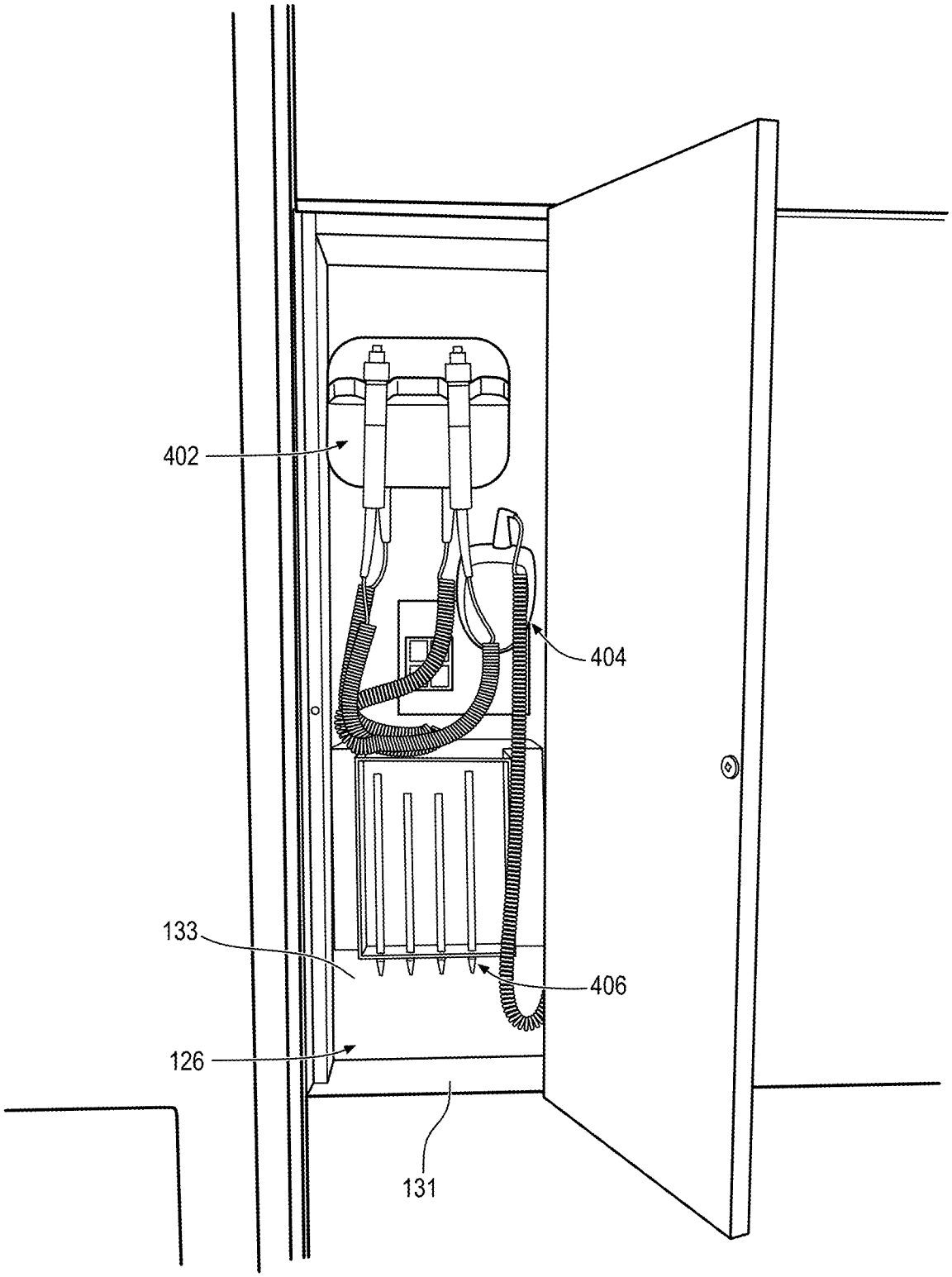
FIG. 4 illustrates a close-up view of a storage space of a modular station in an open configuration, according to implementations of the disclosed subject matter.

Although the square footage of the modular station 100 can be smaller than conventional ER triage spaces, the modular station 100 can efficiently provide equipment, supplies, and/or functionality used for ER triaging. For instance, the modular station 100 shown in FIG. 1B includes a storage space 126 recessed within the side module 150 and covered with a cabinet door (other closure configurations are possible, or the storage space 126 may comprise an open shelf/space). FIG. 3 illustrates a close-up view of the storage space 126, and FIG. 4 illustrates a close-up view of the storage space 126 with the cabinet door thereof in an open position. The storage space 126 can store various medical equipment used for patient diagnosis and/or ER triaging. For instance, in the example shown in FIG. 4, the storage space 126 stores an otoscope or ophthalmoscope 402, a thermometer 404, and specula 406. Other medical equipment usable by a medical practitioner for triaging may be stored within the storage space 126 in other embodiments.

Figure 16:
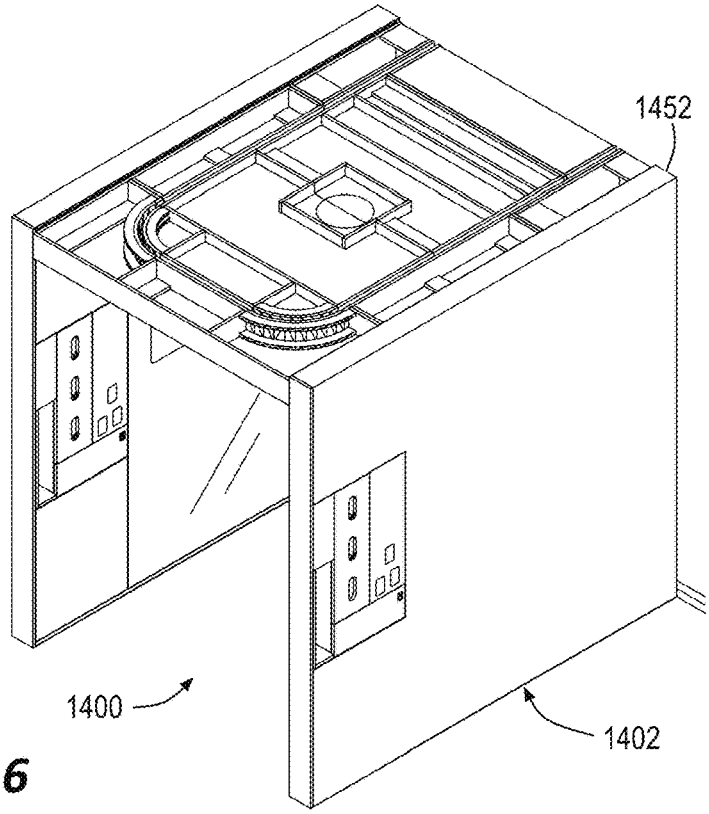
FIG. 16 illustrates a top, front, right isometric view of an example modular station, according to implementations of the disclosed subject matter.

Advantageously, the storage space 126 shown in FIG. 3 is arranged proximate to a front end 302 of the side module 150 (e.g., within about 4 feet, or within about 3 feet, or within about 2.5 feet, or within about 2 feet of the front end of the side module 150), or is arranged distanced from the rear end of the side module 150 (e.g., greater than about 3 feet, greater than about 4 feet, greater than about 5 feet, or greater than about 6 feet from the rear end of the side module 150, see FIG. 16 showing an example rear end 1452 of a side module 1402 of a modular station 1400). Such a configuration can enable a medical practitioner to readily access supplies, instruments, controls, or equipment stored by the storage space 126 that are regularly used for patient diagnosing and/or triaging from a position that is proximate to the point of care for the patient (e.g., rather than accessing such equipment from a position behind the patient, such as on the back module 170).

Figure 5:
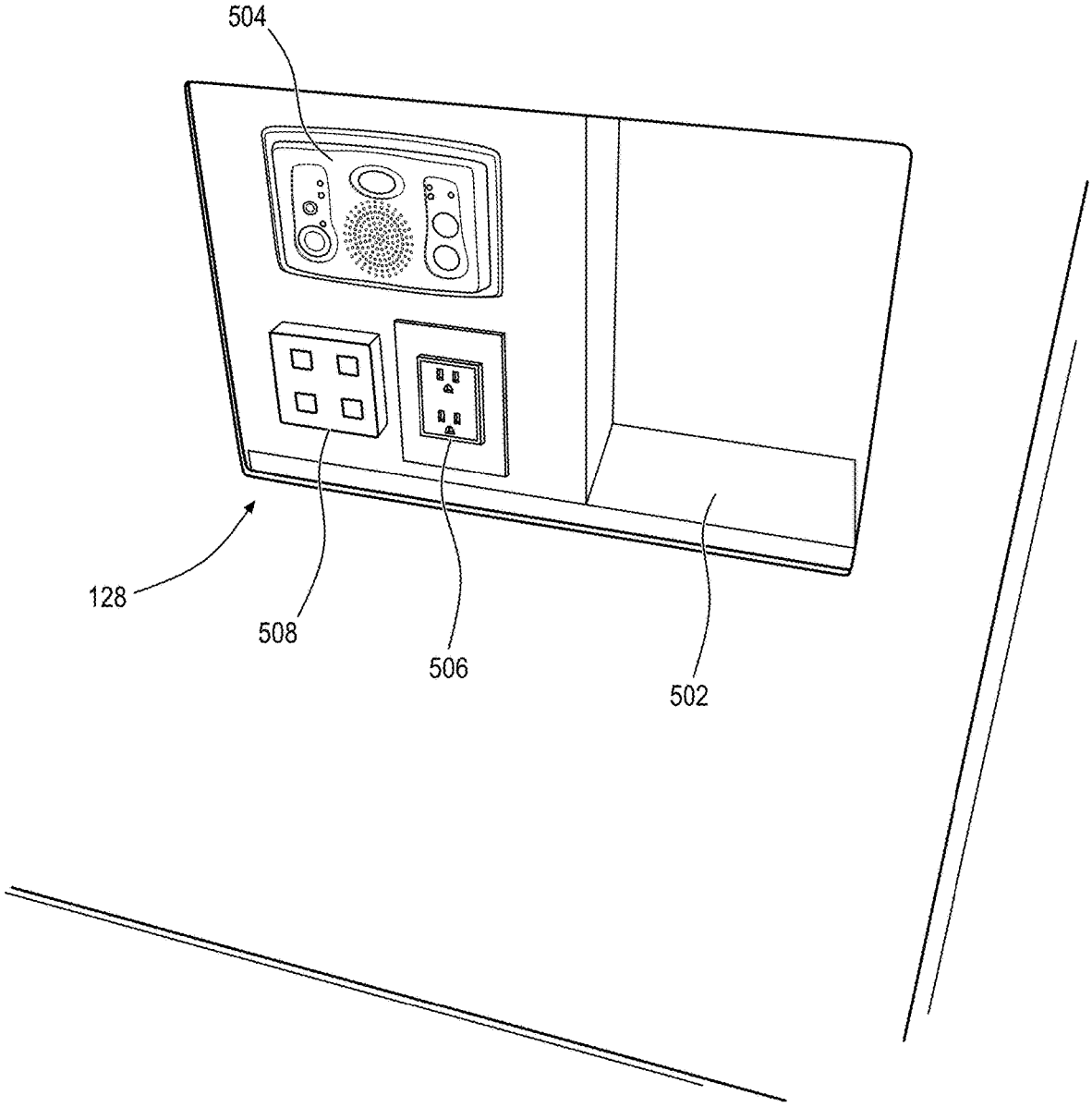
FIG. 5 illustrates a close-up view of a patient panel of a modular station, according to implementations of the disclosed subject matter.

FIG. 1B furthermore illustrates the modular station 100 as including a patient panel 128, which can include various controls and/or functionality accessible to the patient (e.g., when the patient is seated on an exam recliner 102 arranged at position 103 within the modular station 100). FIG. 5 illustrates a close-up view of the patient panel 128. In the example shown in FIG. 5, the patient panel 128 includes a recess 502, on which the patient may place belongings, a practitioner communication device 504 (e.g., to trigger an alarm, indicate occurrence of a code event, request staff assistance, call a medical practitioner, etc.), a power outlet 506 (e.g., for powering patient and/or practitioner devices), and a lighting control device 508. Additional or alternative components may be included at a patient panel 128, in accordance with the disclosed subject matter. In many conventional ER triaging settings, patient beds are arranged distanced from walls, such that providing patients with the feature described above in association with the patient panel 128 necessitates one or more tables that occupy additional floor space or controllers connected to the patient bed (which are often inconvenient for patient access or can be difficult for patients to locate).

Figure 6:
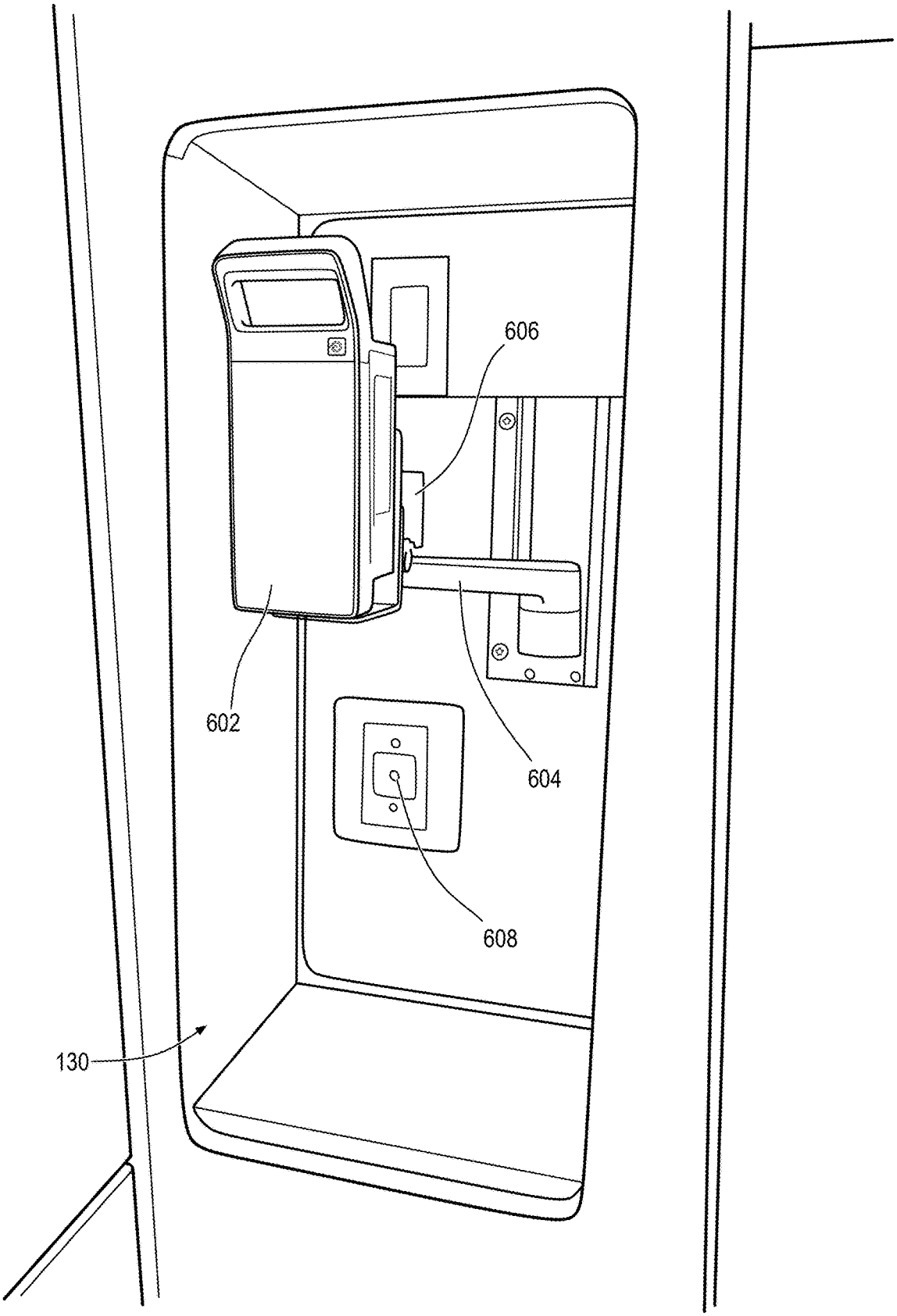
FIG. 6 illustrates close-up views of recesses of a modular station, according to implementations of the disclosed subject matter.

FIG. 1B furthermore illustrates the modular station 100 as including a recess 130 arranged on the back module 170, which may provide access to additional features related to ER triaging and/or patient diagnostics. The recess 130 may be recessed into part of the back module 170, allowing for storage of features related to patient care while mitigating the impact on the free space of the modular station 100. FIG. 6 illustrates a close-up view of the recess 130. In the example shown in FIG. 6, the recess 130 houses a physiological monitor 602, which can display information based on sensor data gathered via one or more sensors arranged to detect patient metrics (e.g., key vital signs such as heart rate, electrocardiogram measurements, blood pressure, respiratory rate, oxygen saturation, end-tidal carbon dioxide, temperature, and/or others). As shown in FIG. 6, the physiological monitor 602 may be positioned on a rotating arm 604 to allow the physiological monitor 602 to be repositionable within and outside of the recess 130. For instance, a medical practitioner may rotate the physiological monitor 602 to a position outside of the recess 130 pursuant to triaging a patient, such that the physiological monitor 602 becomes positioned visible to the medical practitioner from the point of care with the patient. When not in use, the physiological monitor 602 may be rotated to a position within the recess 130.

As shown in FIG. 6, the recess 130 may house additional or alternative components, such as a power duplex 606 and/or a gas port 608 (e.g., for oxygen). In many instances, medical gases are not needed at the triaging stage, so the positioning of the recess 130 on the back module 170 of the modular station 100 can have a minimal or negligible impact on overall efficiency of ER triaging using the modular station 100.

Figure 7:
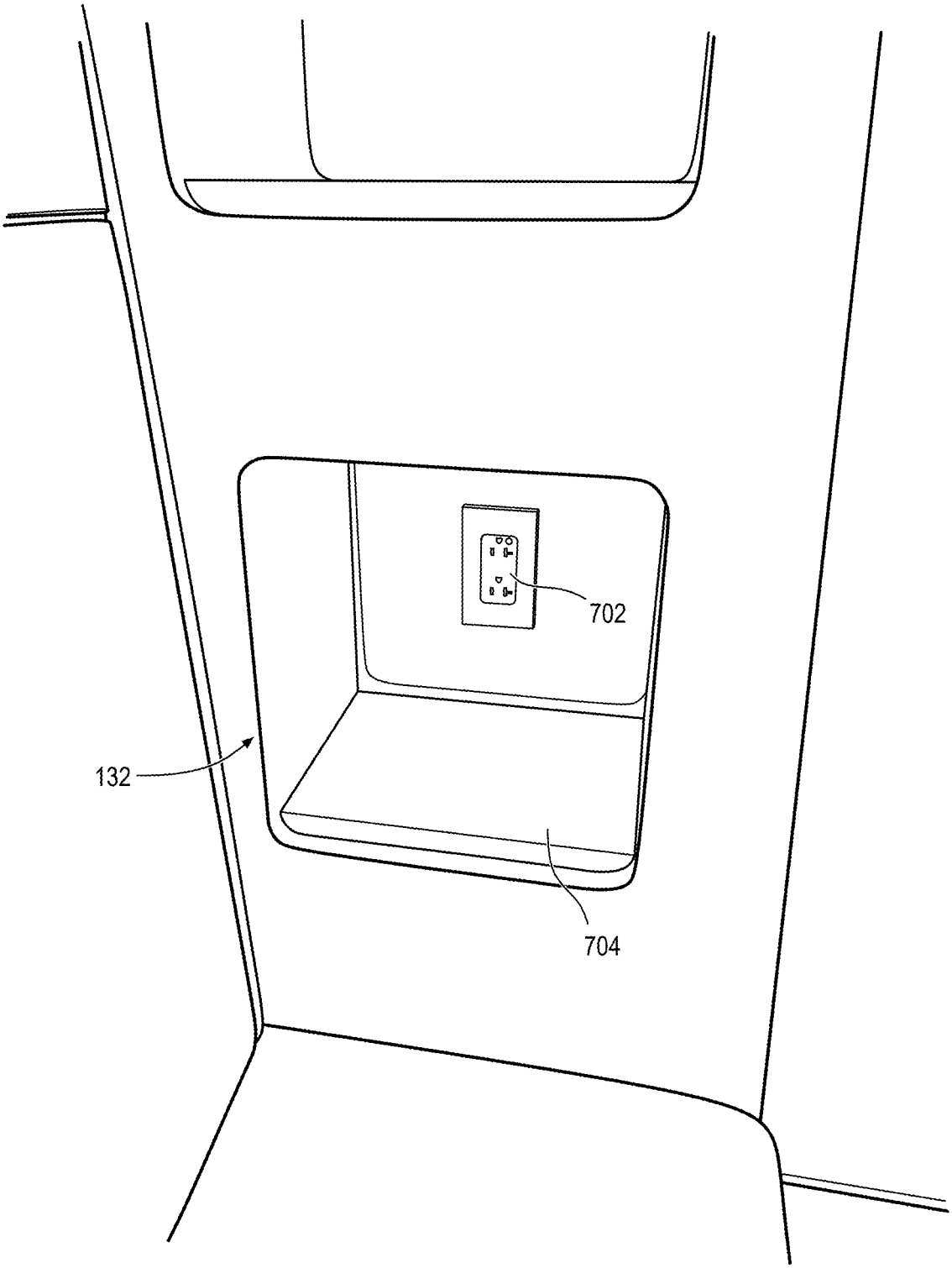
FIG. 7 illustrates close-up views of recesses of a modular station, according to implementations of the disclosed subject matter.

FIG. 1B furthermore illustrates the modular station 100 as including a recess 132 arranged on the back module 170, which can provide access to additional features related to patient triaging. The recess 132 may be recessed into part of the back module 170, for example, within one or both of the towers (see FIG. 17), allowing for storage of features related to patient care while mitigating the impact on the free space of the modular station 100. FIG. 7 illustrates a close-up view of the recess 132. In the example shown in FIG. 7, the recess 132 houses a power outlet 702 and a shelf 704, which may be arranged at a height on the back module 170 that is readily accessible from the bench 108, allowing patient guests, caregivers, family members, and/or others to readily use the features of the recess 132 (e.g., without introducing a table into the modular station 100 that would occupy floor space).

Figure 8:
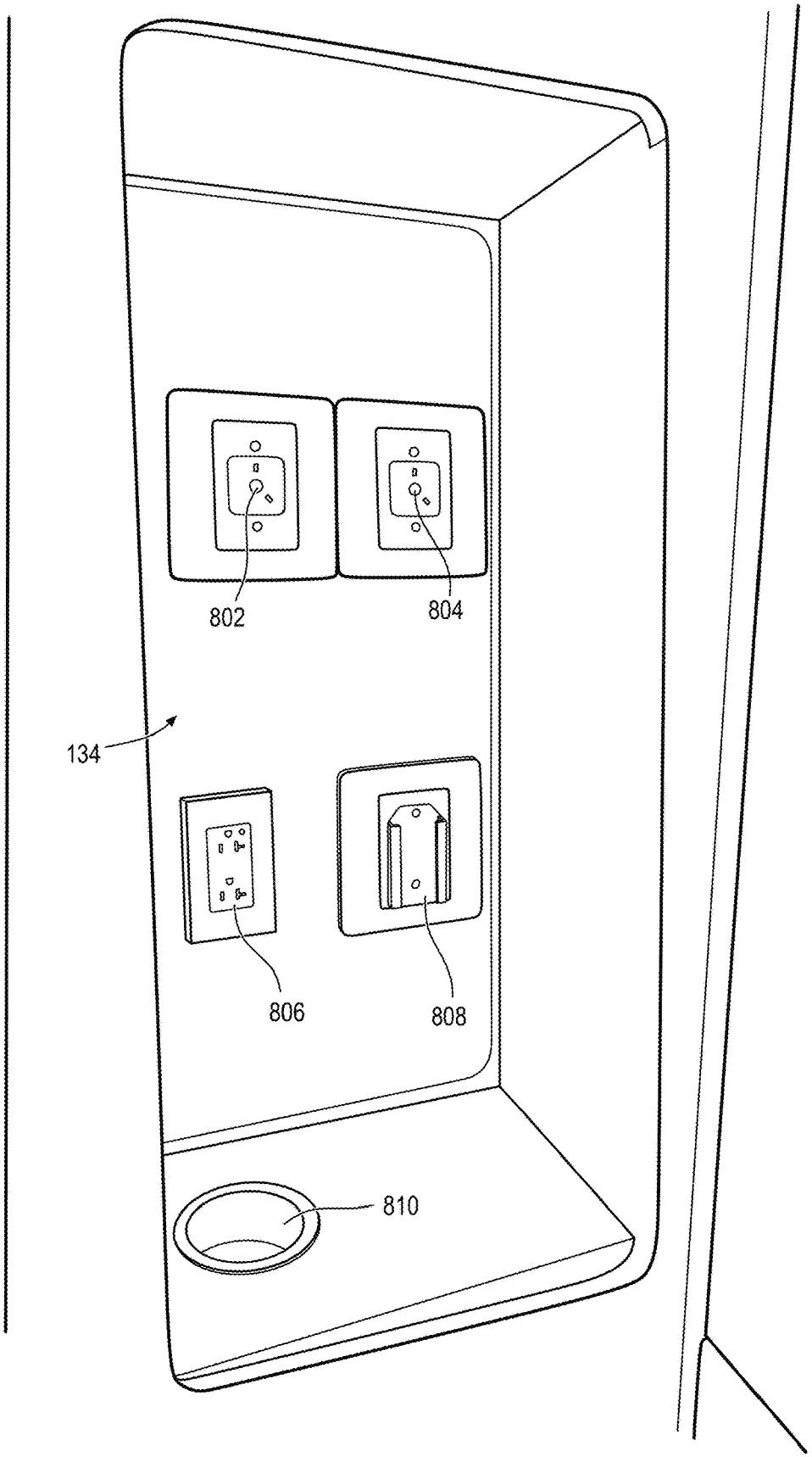
FIG. 8 illustrates close-up views of recesses of a modular station, according to implementations of the disclosed subject matter.

FIG. 1B furthermore illustrates the modular station 100 as including a recess 134 arranged on the back module 170, which can provide access to additional features related to patient triaging. The recess 134 may be recessed into part of the back module 170, allowing for storage of features related to patient care while mitigating the impact on the free space of the modular station 100. FIG. 8 illustrates a close-up view of the recess 134. In the example shown in FIG. 8, the recess 134 houses medical fluid, electrical, or gas ports, including an air port 802 and a vacuum port 804 (other types of medical fluid or gas ports may be used in accordance with the present disclosure). As indicated above, in many instances, medical gases, fluids, and/or vacuum capabilities are not needed at the triaging stage, so the positioning of the recess 134 providing access to these features on the back module 170 of the modular station 100 can have a minimal or negligible impact on overall efficiency of ER triaging using the modular station 100. Furthermore, when medical gases, fluids, and/or vacuum capabilities are needed at the triaging stage, patient guests, caregivers, and/or family members are typically cleared out from the triaging space, which mitigates the impact of the positioning of the recess 134 (and/or recess 130) proximate to the bench 108.

In the example shown in FIG. 8, recess 134 can house additional or alternative features, such as a power outlet 806 and a mount 808 (e.g., for mounting equipment related to using the medical gas, fluid, or vacuum ports). In some instances, the recess 134 may serve as an additional point of access for the sharps receptacle 204 (e.g., via opening 810).

Figure 9:
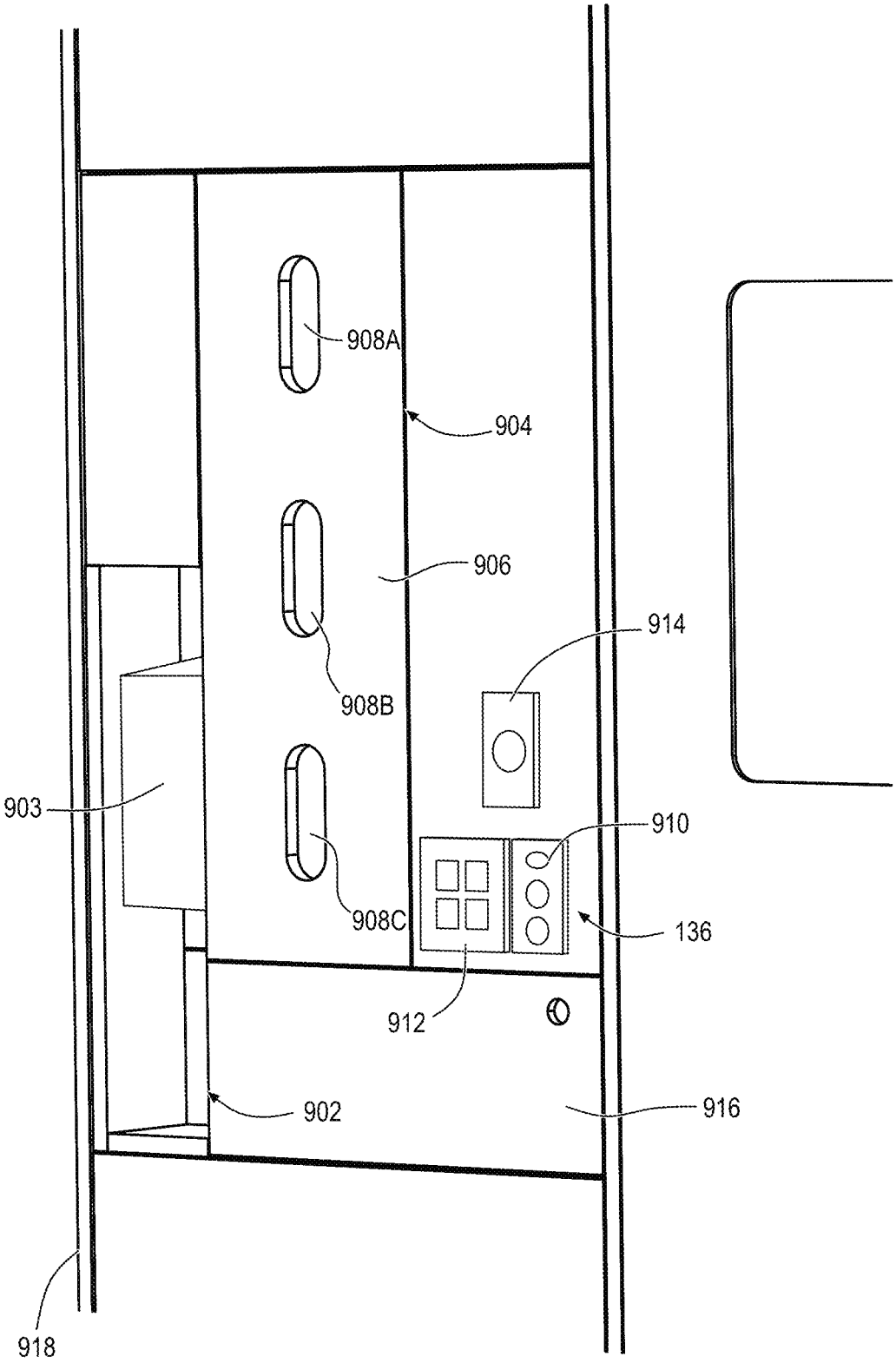
FIG. 9 illustrates a close-up view of a practitioner panel of a modular station, according to implementations of the disclosed subject matter.

FIG. 1B furthermore illustrates the modular station 100 as including a practitioner panel 136 arranged on the side module 160, which can include various controls and/or functionality accessible to the medical practitioner. FIG. 9 illustrates a close-up view of the practitioner panel 136. As shown in FIG. 9, the practitioner panel 136 includes a recess 902 that can store various equipment and/or supplies used pursuant to patient diagnosis, triaging, and/or other care activities. For instance, in the example shown in FIG. 9, the recess 902 houses a hand sanitizer dispenser 903 (additional or alternative componentry may be housed by the recess 902).

Figure 10:
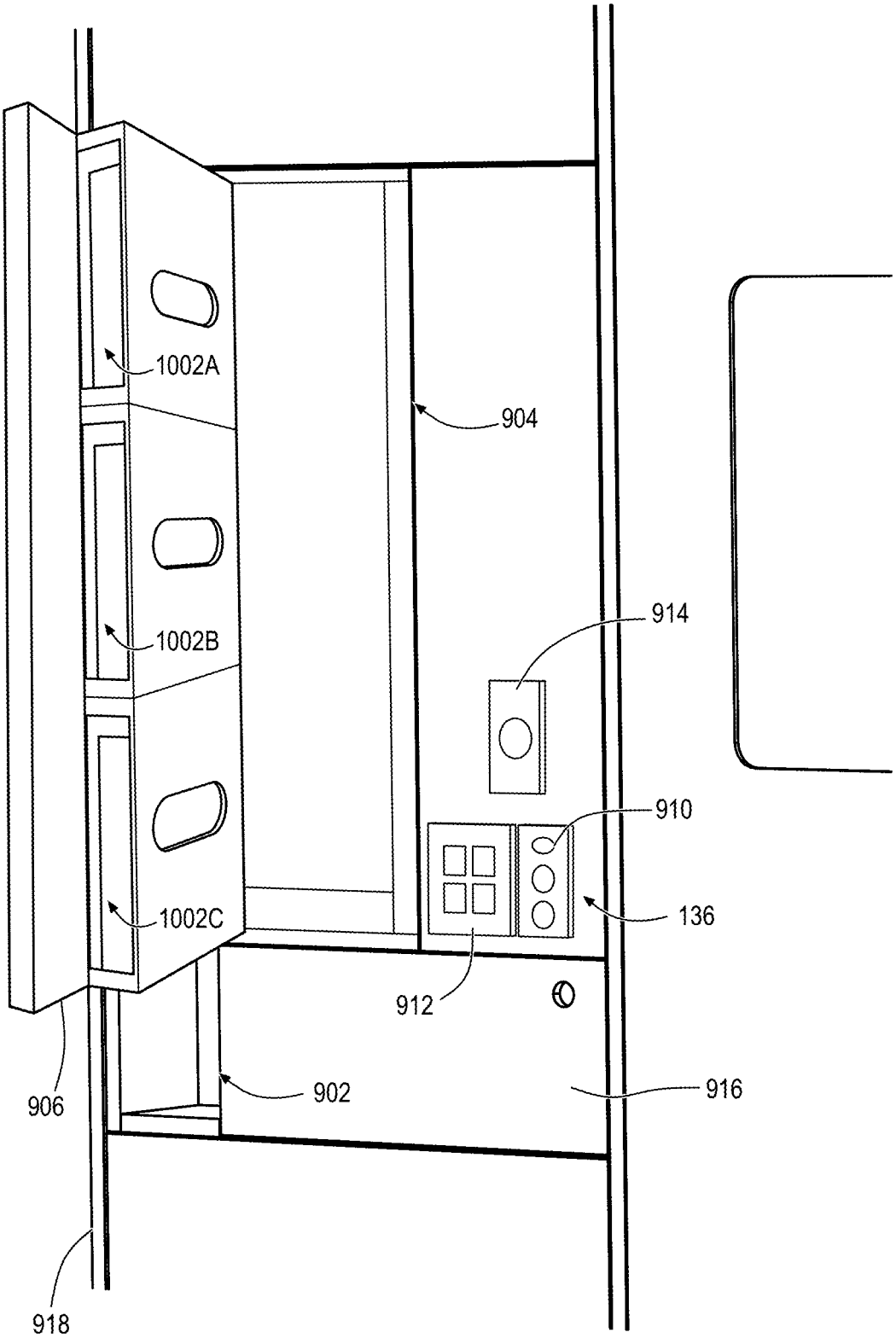
FIG. 10 illustrates a cabinet door of a medical supply dispenser of a practitioner panel of a modular station in an open position, according to implementations of the disclosed subject matter.

The example practitioner panel 136 shown in FIG. 9 additionally includes a medical supply dispenser 904, which may be implemented as a cabinet door 906 including openings 908A, 908B, and/or 908C that can provide access to various medical supplies. FIG. 10 illustrates the cabinet door 906 in an open position, illustrating compartments 1002A, 1002B, and 1002C connected to the cabinet door 906 that may receive medical supplies (such as examination gloves boxes) for access through the corresponding openings 908A, 908B, and 908C. The cabinet door 906 and compartments 1002A, 1002B, and 1002C may provide a convenient means of changing supply units (e.g., boxes) of medical supplies upon or prior to exhaustion of the same. Although examination gloves are showcased in association with the medical supply dispenser 904 and its various components shown in FIGS. 9 and 10, other types of medical supplies may be housed and dispensed using the medical supply dispenser 904 (e.g., masks, hair covers, etc.).

Figure 11:
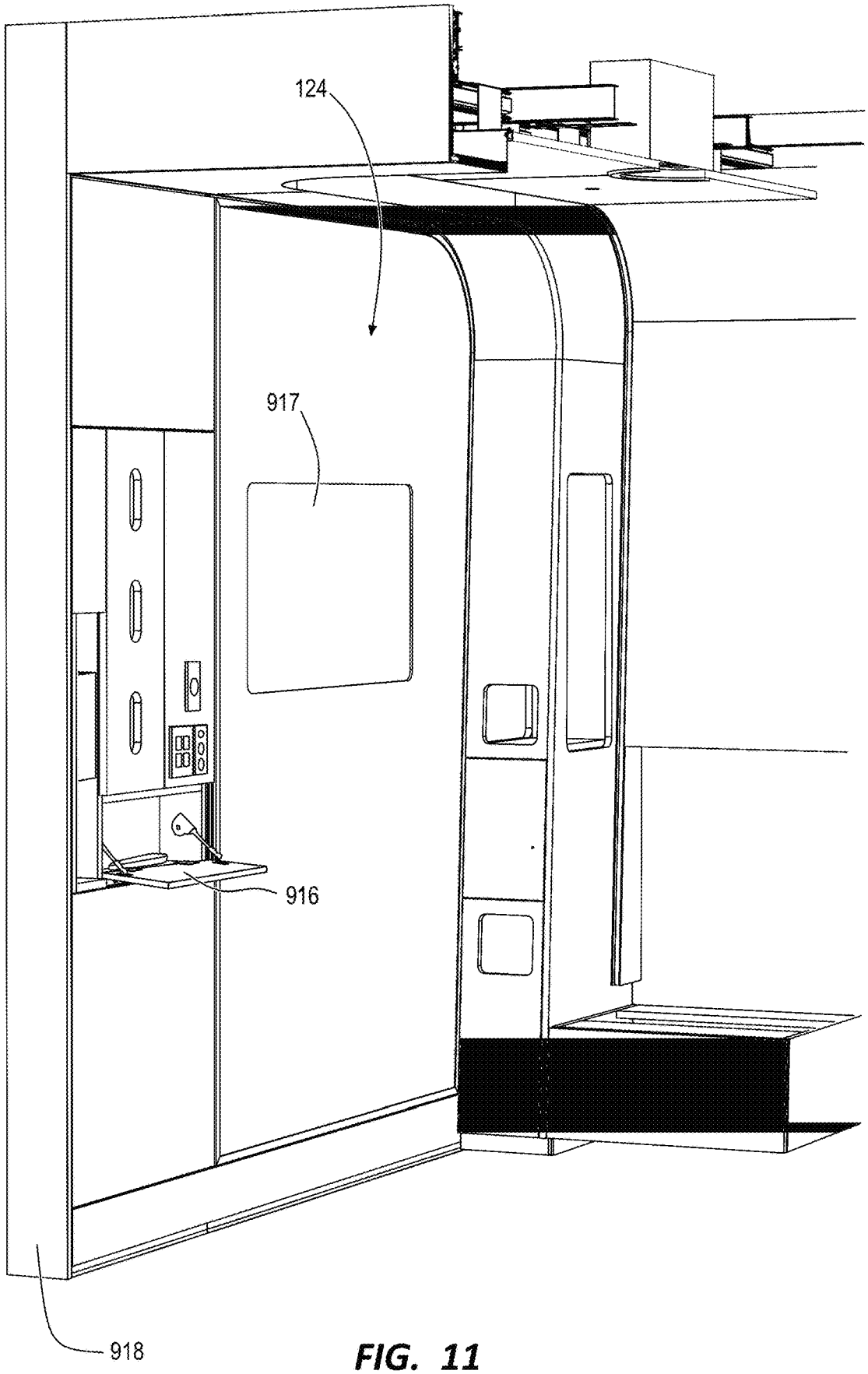
FIG. 11 illustrates a flip-down shelf of a practitioner panel of a modular station in an open position, according to implementations of the disclosed subject matter.

FIG. 9 further illustrates the practitioner panel 136 as including a practitioner communication device 910 (e.g., similar to practitioner communication device 504 of the patient panel 128), a lighting control device 912 (e.g., similar to lighting control device 508 of the patient panel 128), and an exam lighting control device 914 (e.g., for controlling the exam light 104). The practitioner panel 136 can additionally or alternatively include a flip-down shelf 916, which can enable practitioners with a selectively accessible platform on which to set items to be used for patient care (e.g., an IV bag while preparing to hang the same from a component of the exam recliner 102, a shot or other therapeutic in preparation for delivering the same to the patient, etc.). FIG. 9 illustrates the flip-down shelf 916 in a closed configuration, where the flip-down shelf 916 does not obstruct the free space of the modular station 100. When ready for use, the flip-down shelf 916 may be moved into an open configuration, illustrated in FIG. 11. After use, the flip-down shelf 916 may be returned to the closed configuration shown in FIG. 9 to cause the flip-down shelf 916 to refrain from obstructing the free space of the modular station 100. Further, as indicated in FIG. 11, a screen or display 917 can be present on, behind, or adjacent to glass panel 124. In one embodiment, a manufacturer may cut an aperture size to the size of the display 917. In another embodiment, display 917 may be mounted behind at least a portion of glass panel 124. The level of opacity of glass panel 124 can allow a user to see the content displayed on display 917.

Figure 15:
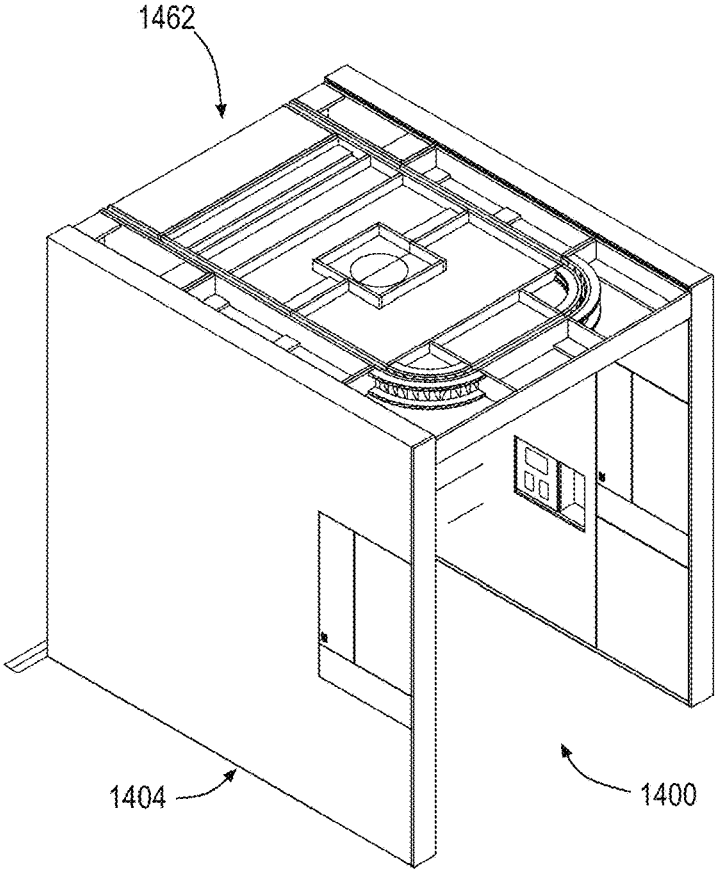
FIG. 15 illustrates a top, front, left isometric view of an example modular station, according to implementations of the disclosed subject matter.

Advantageously, the storage space practitioner panel 136 shown in FIG. 9 is arranged proximate to a front end 918 of the side module 160 (e.g., within about 4 feet, or within about 3 feet, or within about 2.5 feet, or within about 2 feet of the front end of the side module 150), or is arranged distanced from the rear end of the side module 150 (e.g., greater than about 3 feet, greater than about 4 feet, greater than about 5 feet, or greater than about 6 feet from the rear end of the side module 160, see FIG. 15 showing an example rear end 1462 of a side module 1404 of a modular station 1400). Such a configuration can enable a medical practitioner to readily access supplies, instruments, controls, or equipment arranged at the practitioner panel 136 that are regularly used for patient diagnosing and/or triaging from a position that is proximate to the point of care for the patient (e.g., rather than accessing such equipment from a position behind the patient, such as on the back module 170).

A modular station 100 including one or more of the features described herein may provide medical practitioners with access to the supplies, instruments, controls, and/or equipment for performing ER triaging with a reduced footprint relative to conventional ER triaging spaces, while still providing a desirable care experience for patients. For instance, medical practitioners may remain in view of the patient for most tasks, such as when the medical practitioner accesses the storage space 126 and/or the practitioner panel 136. Furthermore, the modular station 100 may provide patients with convenient access to the patient panel 128, and may provide a seating space (e.g., the bench 108) for guests, family members, caretakers, or other individuals associated with the patient with convenient access to a recess 132 providing a shelf 704 and power outlet 702. The foregoing (and other) features and benefits may advantageously be achieved via the modular station 100 with a floor space requirement of less than about 60 square feet (or less than about 50 square feet).

Although various components and/or features of the modular station 100 have been described and/or shown with particular laterality, the laterality of such components and/or features may be varied in different implementations. For instance, when facing the modular station 100 from the perspective shown in FIGS. 1A and 1B, the storage space 126, the patient panel 128, the recess 130, and the recess 132 have been shown and/or described as on the right side of the modular station 100 (e.g., right of the bench 108), whereas the waste container opening 112, the sharps disposal opening 114, the recess 134, and the practitioner panel 136 have been shown and/or described as on the left side of the modular station 100 (e.g., left of the bench 108). However, the laterality (and/or exact positioning) of any one or combination of these components may be reversed in different implementations.

Figure 12:
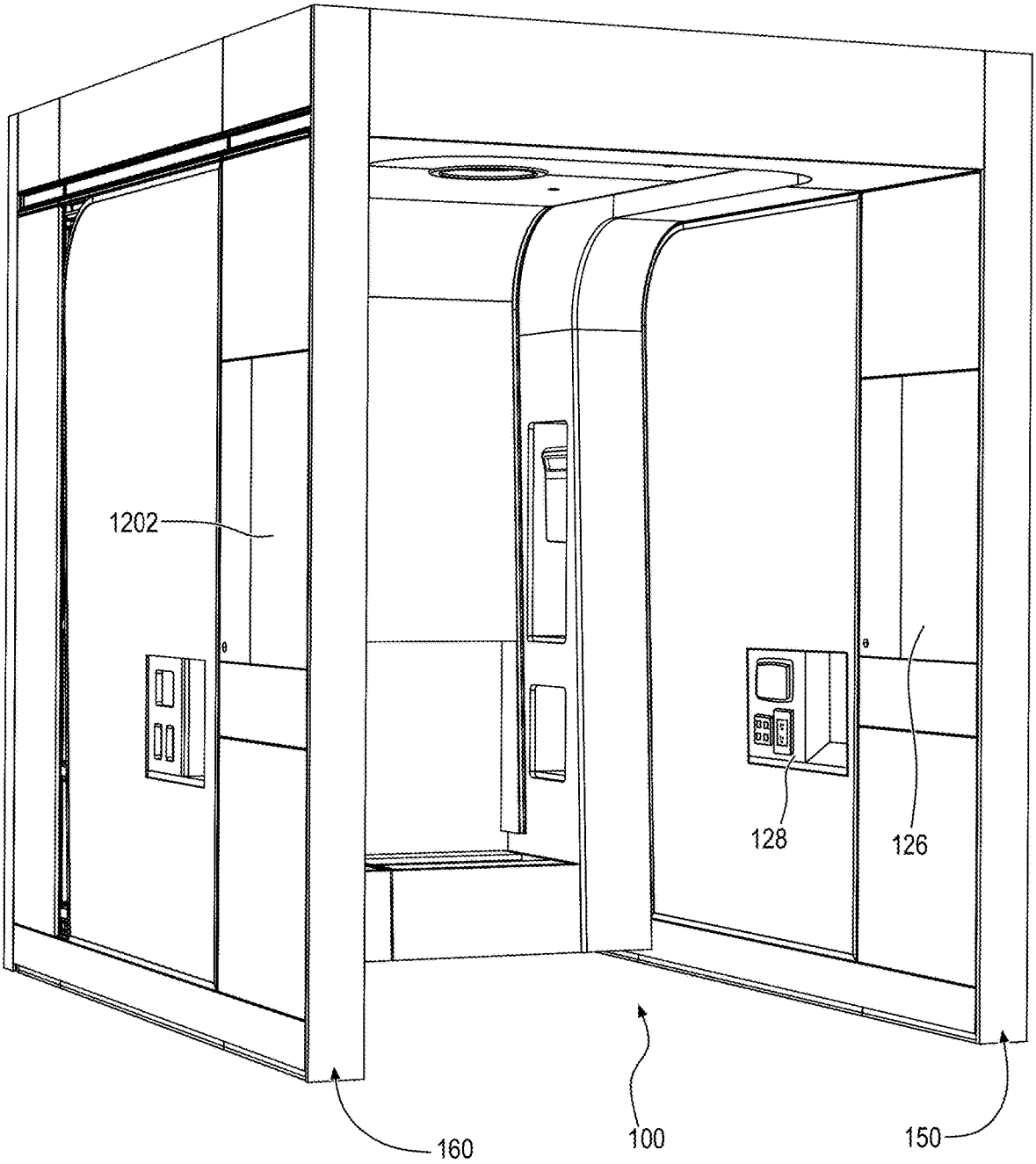
FIG. 12 illustrates a front, left view of the modular station, according to implementations of the disclosed subject matter.

Furthermore, in some implementations, multiple modular stations may be arranged adjacent to one another. In such instances, each of the modular stations may include a respective back module and ceiling module, while adjacent modular stations may share at least one side module. In this regard, a single side module may provide different components for two different modular stations that are arranged adjacent to one another. For example, FIG. 12 illustrates another view of the modular station 100, showing additional aspects of the side module 160. As noted above, the side module 160 can support the practitioner panel 136 for modular station 100, as described above with reference to FIGS. 9, 10, and 11. The back modules of one or more adjacent modular stations may be secured together or may be positioned substantially parallel to each other to align a row or array of modular stations. Users may arrange the row of modular stations against an existing structural wall and/or use the outside face of the back modules as a corridor wall or similar structure. Within a row of modular stations, the storage configuration or design of each station can be substantially similar, meaning that the drawers, cabinets, dispensers, etc. of one modular station may be the same as every other station (i.e., each station having a common design or layout). In another embodiment, the layout or configuration of the side and back modules of each modular station may vary, allowing for a user to specialize each station for a different purpose (e.g., intake in a first, consults in a second, procedures in the third, and an alternative procedure in a fourth).

As shown in FIG. 12, the side module 160 may further support an additional storage space 1202 similar to storage space 126 supported by side module 150 as described hereinabove with reference to FIGS. 3 and 4. The storage space 1202 may house an additional set of medical instruments, components, supplies, and/or controls (e.g., an additional otoscope or ophthalmoscope, thermometer, and/or specula) for a modular station arranged adjacent to modular station 100 (and that shares the side module 150 with the modular station 100). The side module 160 may additionally or alternatively support an additional patient panel 128 for use in the modular station arranged adjacent to modular station 100.

Figure 13:
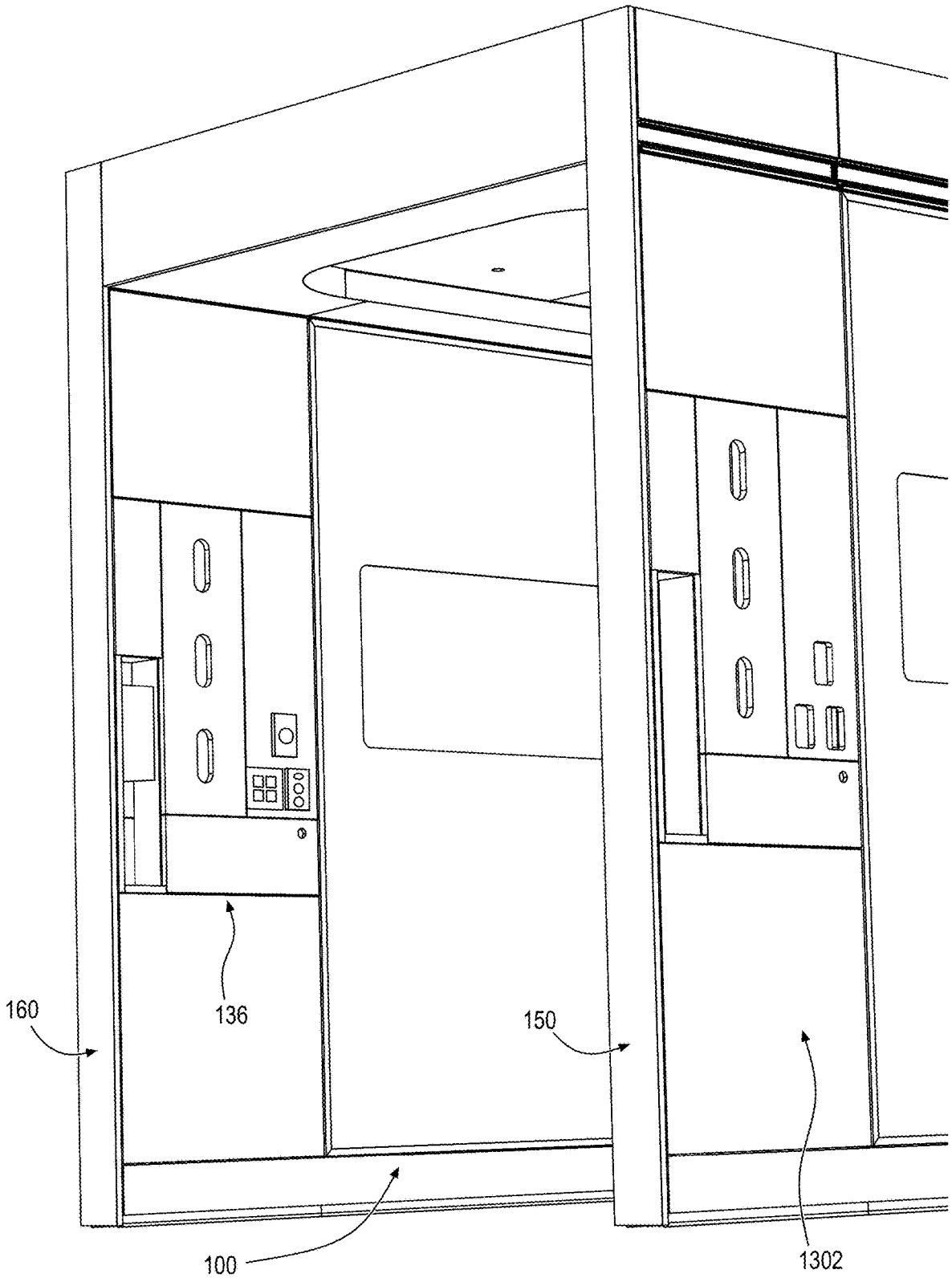
FIG. 13 illustrates a front, right view of the modular station, according to implementations of the disclosed subject matter.

Similarly, FIG. 13 illustrates another view of the modular station 100, showing additional aspects of the side module 150. As noted above, the side module 150 can support the storage space 126 and/or the patient panel 128 for modular station 100, as described above with reference to FIGS. 3, 4, and 5. As shown in FIG. 13, the side module 150 may further support an additional practitioner panel 1302 similar to practitioner panel 136 supported by side module 150 as described hereinabove with reference to FIGS. 9, 10, and 11. The practitioner panel 1302 may provide an additional set of medical instruments, components, supplies, and/or controls (e.g., an additional recess, medical supply dispenser, lighting control device, exam lighting control device, and/or flip-down shelf) for a modular station arranged adjacent to modular station 100 (and that shares the side module 160 with the modular station 100).

Figure 14:
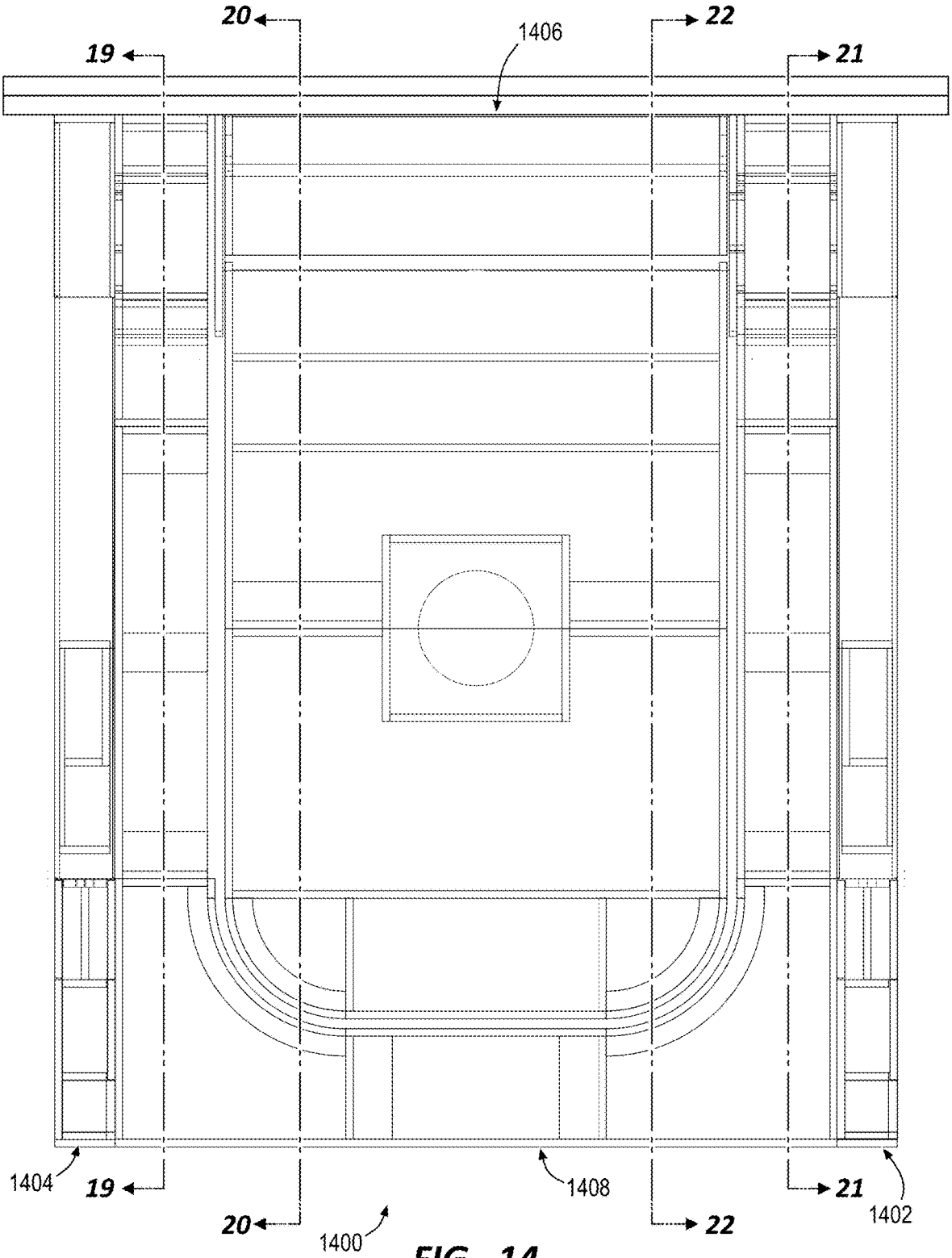
FIG. 14 illustrates a top view of components of a modular station, according to implementations of the disclosed subject matter.

FIG. 14 illustrates a top view of components of a modular station 1400 (e.g., corresponding to modular station 100) including side modules 1402 and 1404, back module 1406, and ceiling module 1408. The side modules 1402 and 1404, the back module 1406, and the ceiling module 1408 can include one or more features described hereinabove, such as an exam light, recessed lighting, a bench, supply drawers, a waster container and associated opening(s), a sharps receptacle and associated opening(s), accent materials, glass panels, storage spaces, a patient panel, recesses, a practitioner panel, and related components/features. FIG. 14 depicts section lines labeled with Figure numbers (i.e., "FIG. 19", "FIG. 20", "FIG. 21", "FIG. 22") indicating section views of the modular station 1400 shown in other Figures.

Figure 17:
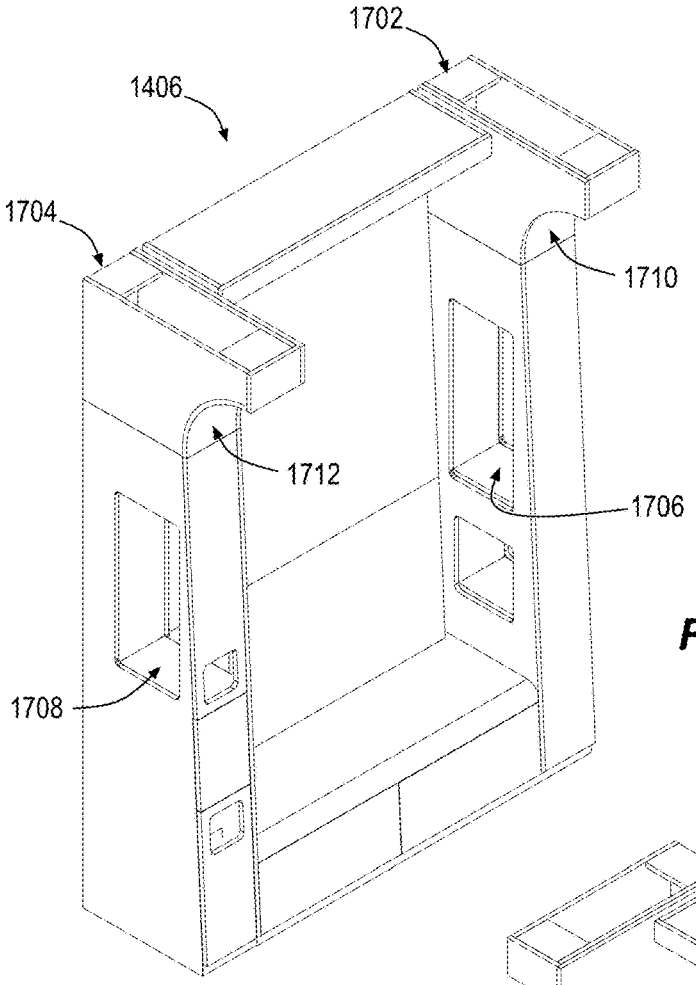
FIG. 17 illustrates a top, front, left isometric view of a back module of an example modular station, according to implementations of the disclosed subject matter.
Figure 18:
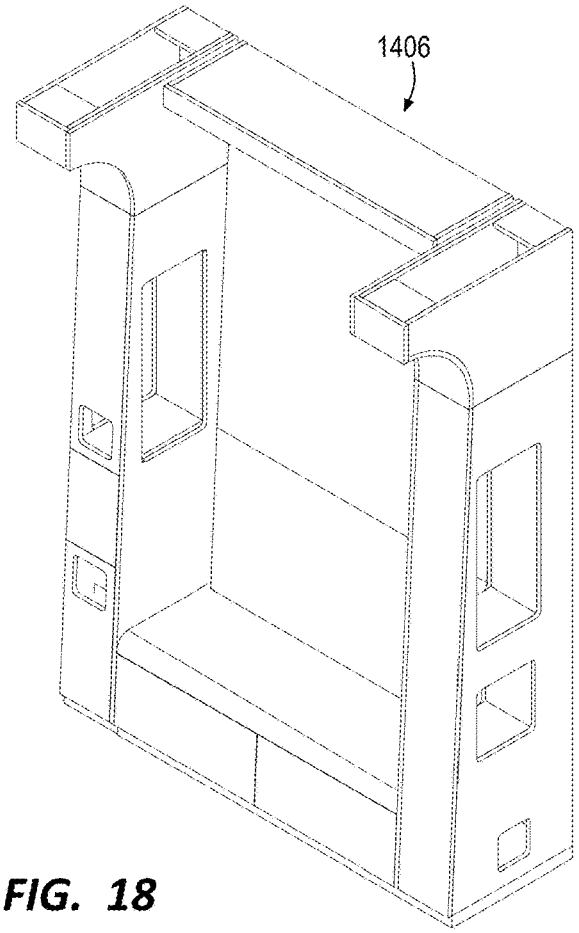
FIG. 18 illustrates a top, front, left isometric view of a back module of an example modular station, according to implementations of the disclosed subject matter.

FIGS. 15 and 16 illustrate isometric views of the example modular station 1400. FIGS. 17 and 18 illustrate example isometric views of the back module 1406 of the modular station 1400. FIG. 17 illustrates that the back module 1406 can include a right tower 1702 and a left tower 1704, with each of the right tower 1702 and the left tower 1704 comprising gable cutouts 1706 and 1708, respectively (each of the gable cutouts 1706 and 1708 comprising a respective left gable cutout and a respective right gable cutout). The right tower 1702 and the left tower 1704 can support various features described hereinabove, such as the waste container opening 112, sharps disposal opening 114, recess 130, recess 132, recess 134, and/or features/components associated therewith. Right tower 1702 and left tower 1704 can be positioned at or adjacent to opposing ends 107*a* and 107*b* of bench 108. One or more recesses or cabinets of the first tower can provide a first opening that faces the second tower. Similarly, the opening or recesses of the second tower can face the right tower. These openings can allow patients or family members to have easy access to storage for their personal belongings. These openings can additionally or alternatively house displays, fluid/gas/electrical ports, and/or other components. FIG. 17 furthermore illustrates that the right tower 1702 and the left tower 1704 can each include curved soffit components 1710 and 1712, respectively.

Figure 19:
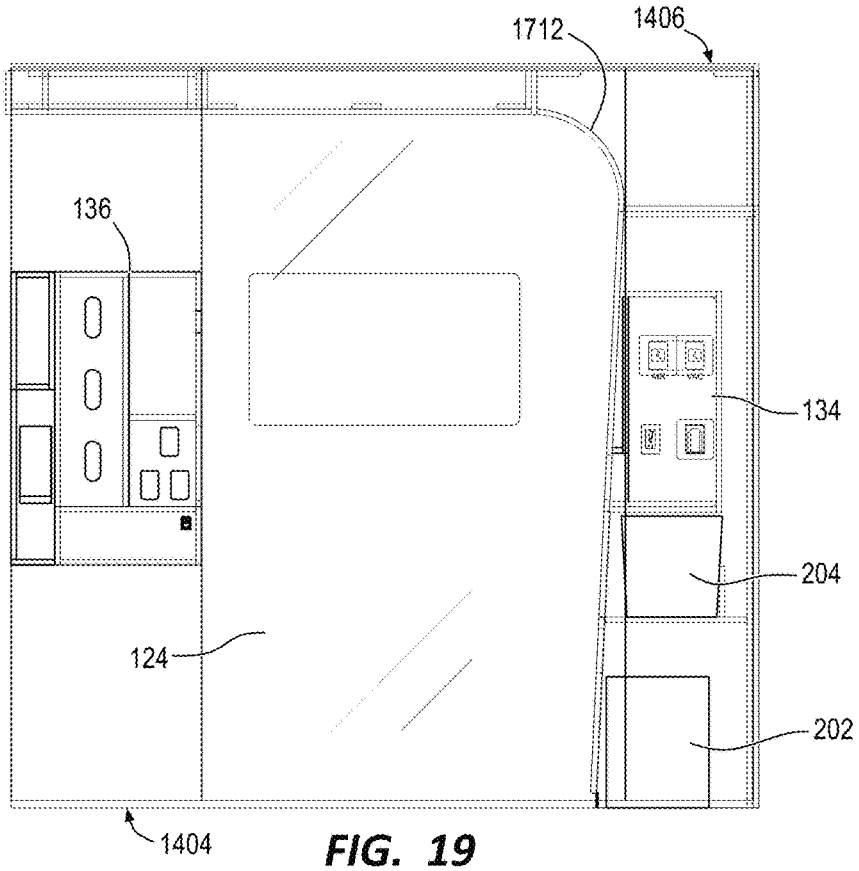
FIG. 19 illustrates a sectional view of parts of a back module and a side module of an example modular station, according to implementations of the disclosed subject matter.

FIG. 19 illustrates a sectional view of part of the back module 1406 and the side module 1404 (with the section line being cut through the left tower 1704, as indicated in FIG. 14). FIG. 19 provides various example dimensions and specifications for features/components of the modular station 1400. FIG. 19 also refers to components of the double-sided equipment cabinet. The double-sided equipment cabinet can include or provide features corresponding to the practitioner panel 136 (on one side) and/or the storage space 126 (on an opposite side) described hereinabove (e.g., on different sides of the side module 1404). One or both of the side modules 1402 and 1404 can include a double-sided equipment cabinet (e.g., with a common design). Receptacles 202 and 204, as well as the practitioner panel 136, are shown in FIG. 19. Further, FIG. 19 illustrates a portion of recess 134 and its orientation relative to side module 1404 (i.e., recess 134 opening towards the interior of the modular station or towards what would be the opposing tower (not shown).

Figure 20:
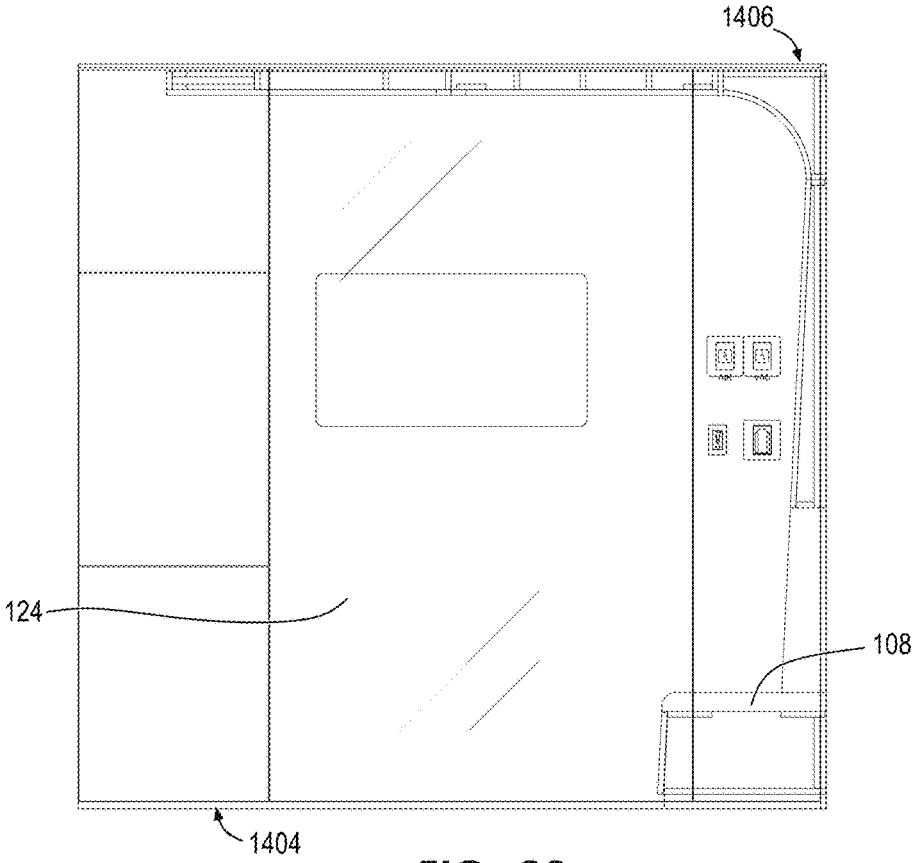
FIG. 20 illustrates another sectional view of parts of a back module and a side module of an example modular station, according to implementations of the disclosed subject matter.

FIG. 20 illustrates a sectional view of part of the back module 1406 and the side module 1404 (with the section line being positioned as indicated in FIG. 14). FIG. 20 provides various example dimensions and specifications for features/components of the modular station 1400. FIG. 20 also refers to components such as the bench 108 and glass panel 124.

Figure 21:
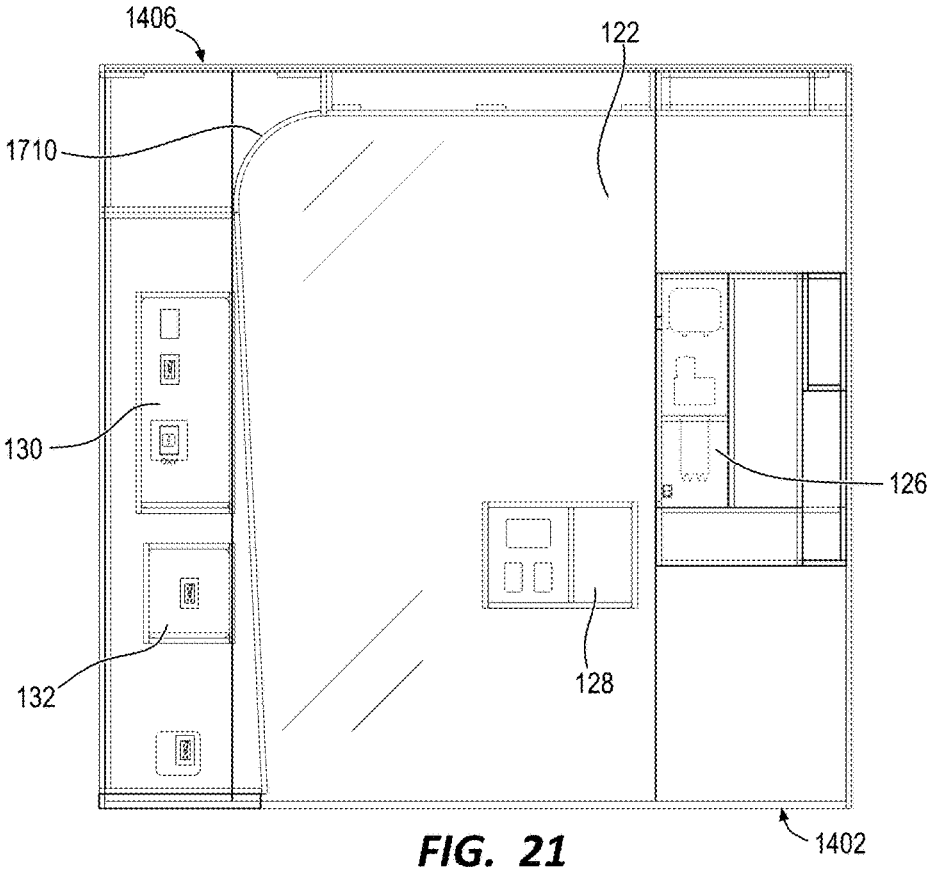
FIG. 21 illustrates yet another sectional view of parts of a back module and a side module of an example modular station, according to implementations of the disclosed subject matter.

FIG. 21 illustrates a sectional view of part of the back module 1406 and the side module 1402 (with the section line being cut through the right tower 1702, as indicated in FIG. 14). FIG. 21 provides various example dimensions and specifications for features/components of the modular station 1400, such as the curved soffit component 1710, recess 130, recess 132, patient panel 128, and storage space 126. FIG. 21 also refers to components of the ceiling module 1408, the double-sided equipment cabinet, and the patient panel 128. One or both of the side modules 1402 and 1404 can include a patient panel. The patient panel can be on, in, or adjacent to glass panel 122. As with display 917, a manufacturer may position patient panel 128 through glass panel 128 to allow access to ports, switches/buttons, and shelving.

Figure 22:
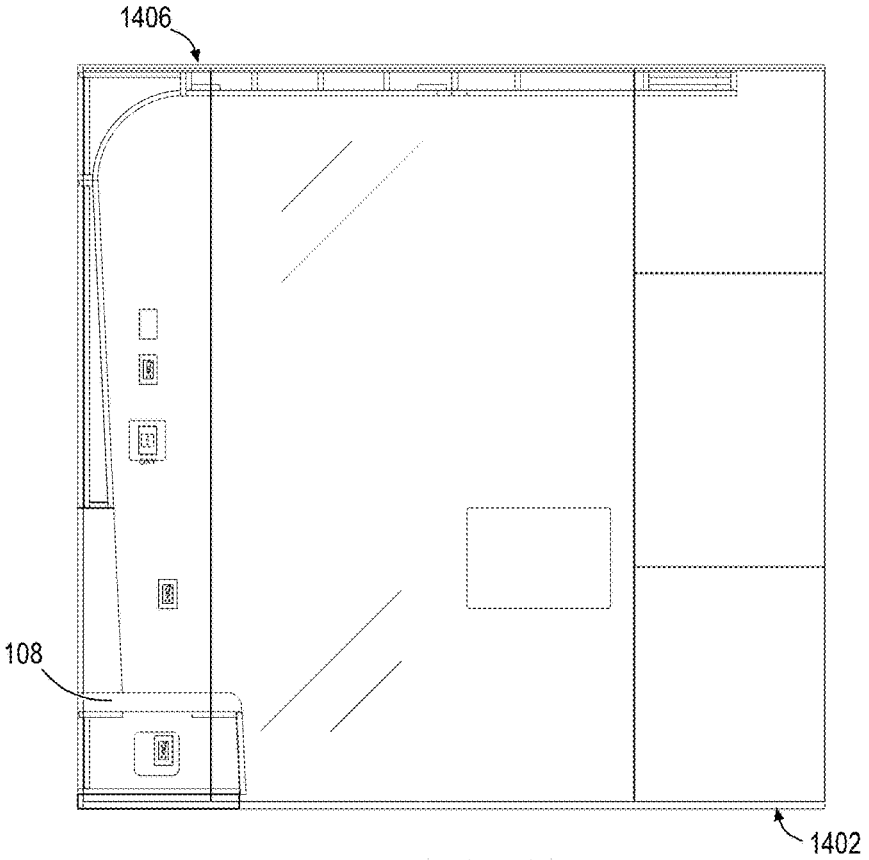
FIG. 22 illustrates another sectional view of parts of a back module and a side module of an example modular station, according to implementations of the disclosed subject matter.

FIG. 22 illustrates a sectional view of part of the back module 1406 and the side module 1402 (with the section line being positioned as indicated in FIG. 14). FIG. 22 provides various example dimensions and specifications for features/components of the modular station 1400. For example, FIG. 22 shows a portion of bench 108. FIG. 22 also refers to components of the ceiling module 1408.

Figure 23:
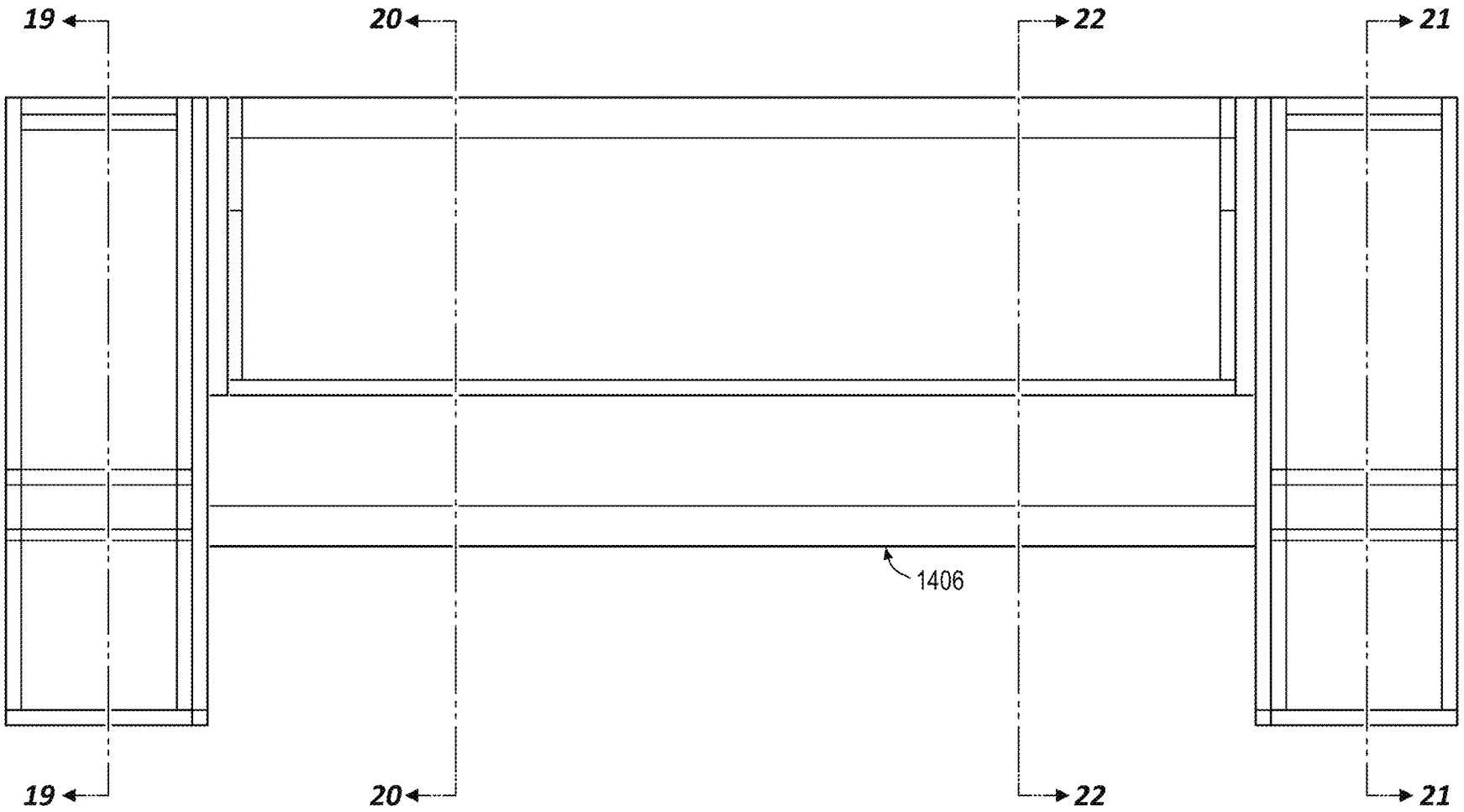
FIG. 23 illustrates a plan view of a back module of an example modular station, according to implementations of the disclosed subject matter.
Figure 24:
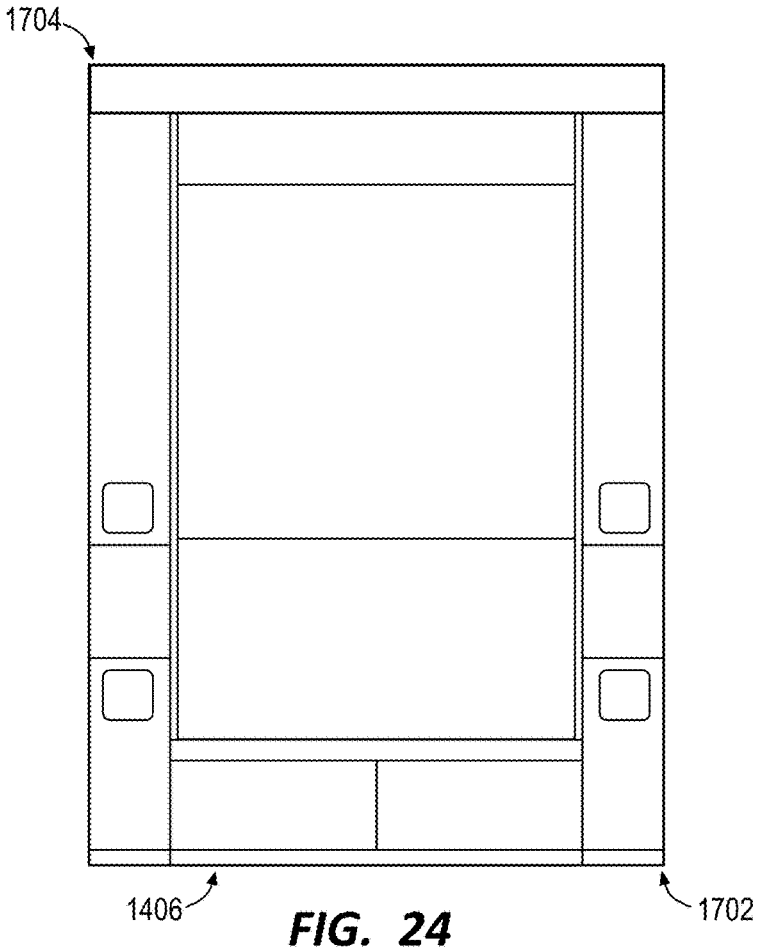
FIG. 24 illustrates a front view of a back module of an example modular station, according to implementations of the disclosed subject matter.
Figure 25:
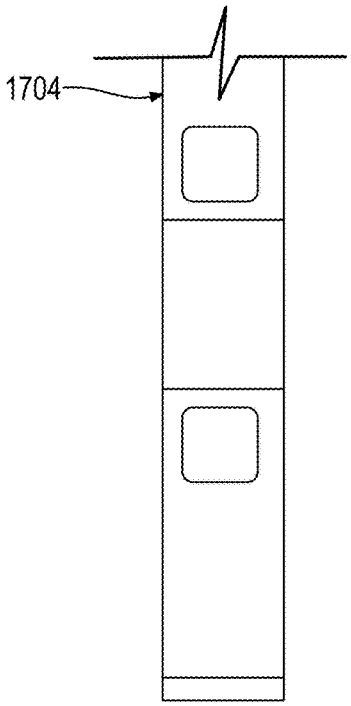
FIG. 25 illustrates a close-up front view of the disposal features of a back module of an example modular station, according to implementations of the disclosed subject matter.

FIG. 23 illustrates a plan view of the back module 1406, illustrating example dimensions therefor. FIG. 23 depicts section lines labeled with Figure numbers (i.e., "FIG. 19", "FIG. 20", "FIG. 21", "FIG. 22") indicating section views of the modular station 1400 shown in other Figures. FIG. 24 illustrates a front view of the back module 1406. FIG. 24 provides various example dimensions and specifications for features/components of the back module 1406. FIG. 24 also refers to components of the disposal features of the left tower 1704, such as the waste container opening, the sharps disposal opening, etc. FIG. 25 provides additional details and example dimensions related to the disposal features on the left tower 1704.

Figure 26:
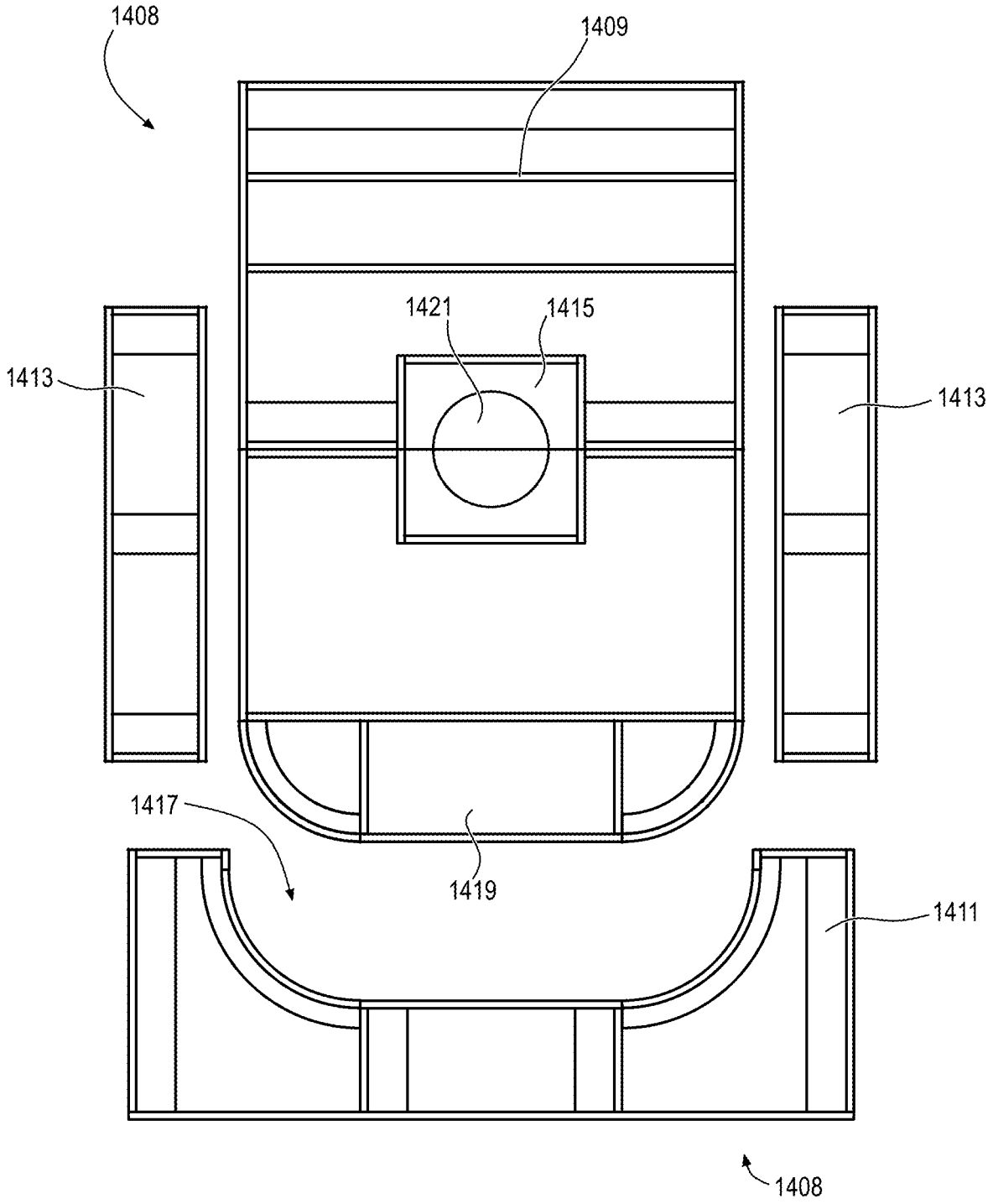
FIG. 26 illustrates a plan view of example components of a ceiling module of a modular station, according to implementations of the disclosed subject matter.

FIG. 26 illustrates a plan view of example components of the ceiling module 1408 of the modular station 1400, including example dimensions and specifications. Ceiling module 1408 can include one or more ceiling boxes 1413, an interior box 1415, a front ceiling bridge 1411, and a center ceiling assembly 1409. The multipart configuration of the ceiling module 1408 advantageously allows for easier shipping as well as customizability between modular stations. For example, in a row of assembled modular stations, the components of the ceiling module 1408 may vary to provide aesthetic or functional differences such as color, material type, and lighting features. Front ceiling bridge 1411 can comprise a slot 1417 configured to receive a rounded edge 1419 of the center ceiling assembly 1409, allowing for front ceiling bridge 1411 to be secured to the center ceiling assembly 1409. Slot 1417 can be a concave edge of the front ceiling bridge 1411. A user may secure the front ceiling bridge to one or more ceiling boxes at either end of the concaved slot ##.

Interior box 1415 can include a frame mount 1421 configured to support a motorized exam light. A manufacturer can position the interior box 1415 to allow for the positioning of the motorized exam light (e.g., centered within the modular station). In one embodiment, the motorized exam light may be fixed but adjustable in its direction. In contrast, in another embodiment, the motorized exam light may be adjustable in position through an adjustable arm or rail system. While certain embodiments of the present disclosure have been described in detail, with reference to specific configurations, parameters, components, elements, etcetera, the descriptions are illustrative and are not to be construed as limiting the scope of the claimed invention.

Furthermore, it should be understood that for any given element of component of a described embodiment, any of the possible alternatives listed for that element or component may generally be used individually or in combination with one another, unless implicitly or explicitly stated otherwise.

In addition, unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, less than 1%, less than 0.1%, or less than 0.01% of the stated amount, value, or condition. At the very least, and not as an attempt to limit the application of the doctrine of equivalents to the scope of the claims, each numerical parameter should be construed in light of the number of reported significant digits and by applying ordinary rounding techniques.

Any headings and subheadings used herein are for organizational purposes only and are not meant to be used to limit the scope of the description or the claims.

It will also be noted that, as used in this specification and the appended claims, the singular forms "a," "an" and "the" do not exclude plural referents unless the context clearly dictates otherwise. Thus, for example, an embodiment referencing a singular referent (e.g., "widget") may also include two or more such referents.

It will also be appreciated that embodiments described herein may also include properties and/or features (e.g., ingredients, components, members, elements, parts, and/or regions) described in one or more separate embodiments and are not necessarily limited strictly to the features expressly described for that particular embodiment. Accordingly, the various features of a given embodiment can be combined with and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include such features.

What is claimed is:

1. A modular treatment, examination, and waiting station, comprising:

a back module, the back module comprising:

a bench comprising a first end and a second end, the bench being positioned along a lower portion of the back module, a first tower positioned at the first end of the bench, and a second tower positioned at the second end of the bench;

a first side module connected to the back module, the first side module comprising a first storage space recessed into the first side module; and a second side module connected to the back module, the second side module comprising a second storage space recessed into the second side module wherein the first side module and the second side module extend from the back module in a same direction, wherein a floor space defined by the back module, the first side module, the second side module, and front ends of the first side module and the second side module comprises less than about 50 square feet, and wherein the first side module or the second side module comprises a double-sided equipment cabinet, wherein:

the bench, the first tower, and the second tower each have one or more recesses or cabinets that allow a user to gain access to a respective internal space, and at least a first recess or cabinet of the one or more recesses or cabinets of the first tower provides a first opening that faces the second tower.

2. The modular treatment, examination, and waiting station of claim 1, wherein either the first tower or the second tower defines a first recess comprising a display, and wherein the display is mounted on a rotatable arm such that the display can be deployed outside of the recess for use by a user and stored completely within the recess when not in use by the user.

3. The modular treatment, examination, and waiting station of claim 1, wherein the first side module has at least the first storage space accessible from a first side and a third storage space accessible from a second side.

4. The modular treatment, examination, and waiting station of claim 1, further comprising a ceiling module, the ceiling module being at least partially supportable by the first tower and the second tower of the back module.

5. The modular treatment, examination, and waiting station of claim 4, wherein the first tower and the second tower comprise curved soffit components that provide a visibly smooth curved transition between the back module and the ceiling module.

6. The modular treatment, examination, and waiting station of claim 4, wherein each of the first tower and second tower comprises at least one of a fluid port, an electrical port, or a gas port that is at least partially retained in the one or more recesses or cabinets.

7. The modular treatment, examination, and waiting station of claim 1, further comprising continuous recessed lighting that extends over at least part of the back module and a ceiling module.

8. The modular treatment, examination, and waiting station of claim 7, wherein the continuous recessed lighting extends proximate to a floor below the bench of the back module and further extends over either the first side module or second side module, and wherein the continuous recessed lighting does not extend into a free space defined by the back module, first side module, second side module, ceiling module, and the front ends of the first side module and the second side module.

9. The modular treatment, examination, and waiting station of claim 1, wherein the first storage space is accessible by an opening defined by a first cabinet door.

10. The modular treatment, examination, and waiting station of claim 1, further comprising an exam recliner, the exam recliner being configured to allow a patient to lie flat in an elevated position while remaining within the floor space.

11. The modular treatment, examination, and waiting station of claim 1, wherein each of the first side module, the second side module, and the back module comprises:

one or more internal horizontal frames;

one or more internal vertical frames; and one or more panels or tiles, wherein:

the one or more panels or tiles are selectably supported by either the horizontal frames or the vertical frames, and a first panel of the one or more panels or tiles defines a door that allows access to the first storage space.

12. The modular treatment, examination, and waiting station of claim 11, wherein a planar offset between the door that allows access to the first storage space and all of the one or more panels or tiles of the first side module is less than 5 inches.

13. The modular treatment, examination, and waiting station of claim 1, wherein the floor space is further defined by a base frame comprising one or more modular floor panels supported by one or more adjustable leveling feet.

14. The modular treatment, examination, and waiting station of claim 1, wherein the first storage space of the first side module is positioned on the first side module within 3 feet of the front end of the first side module, and wherein the second storage space of the second side module is positioned on the second side module within 3 feet of the front end of the second side module.

15. A modular treatment, examination, and waiting station, comprising:

a back module, the back module comprising a first end and a second end, the back module comprising:

a first tower positioned at the first end of the back module, and a second tower positioned at the second end of the back module;

a first side module connected to the back module, the first side module comprising a first storage space recessed into the first side module; and a second side module connected to the back module, the second side module comprising a second storage space recessed into the second side module, wherein the first side module and the second side module extend from the back module in a same direction, wherein a floor space defined by the back module, the first side module, the second side module, and front ends of the first side module and the second side module comprises less than about 50 square feet, and wherein the first storage space is positioned on the first side module within 3 feet of the front end of the first side module, and wherein the second storage space is positioned on the second side module within 3 feet of the front end of the second side module, wherein:

either the first tower or the second tower defines a recess comprising a display, and the display is mounted on a rotatable arm such that the display can be deployed outside of the recess for use by a user and stored completely within the recess when not in use by the user.

16. The modular treatment, examination, and waiting station of claim 15, further comprising continuous recessed lighting that extends over at least part of the back module and a ceiling module, wherein the continuous recessed lighting does not extend into a free space defined by the back module, first side module, second side module, ceiling module, and the front ends of the first side module and the second side module.

17. A modular station system comprising:

a first back module;

a second back module arranged substantially parallel with the first back module;

a first side module secured to both the first back module and the second back module, the first side module comprising a first storage space recessed into the first side module;

a second side module secured to the first back module, wherein the first side module, the second side module, and the first back module define a first modular treatment, examination, and waiting station; and a third side module secured to the second back module, wherein the first side module, the third side module, and the second back module define a second modular treatment, examination, and waiting station, wherein the first storage space is accessible by way of the first modular treatment, examination, and waiting station, and a second storage space defined by the first side module is accessible by way of the second modular treatment, examination, and waiting station, wherein:

the first storage space and the second storage space are positioned on the first side module within 3 feet of a front end of the first side module.

18. The modular station system of claim 17, wherein the first modular treatment, examination, and waiting station comprises a first set of equipment cabinets, and the second modular treatment, examination, and waiting station comprises a second set of equipment cabinets, and the first set of equipment cabinets and the second set of equipment cabinets are identical.

19. The modular station system of claim 17, wherein the first side module comprises one or more vertical frames and one or more horizontal frames, and wherein one or more modular tiles or panels are selectively couplable to the one or more vertical frames and the one or more horizontal frames to define the first storage space.

20. The modular station system of claim 17, wherein the first side module, the second side module, and the third side module each comprise a storage space, and wherein the storage space of each of the first side module, the second side module, and the third side module have modular components with a common design.

* * * * *